US008075027B2

(12) United States Patent
Zweibohmer

(10) Patent No.: US 8,075,027 B2
(45) Date of Patent: Dec. 13, 2011

(54) LATCH ASSEMBLY WITH SELECTIVELY ASSEMBLED COMPONENTS

(75) Inventor: Dennis J. Zweibohmer, Ionia, IA (US)

(73) Assignee: Tri/Mark Corporation, New Hampton, IA (US)

( * ) Notice: Subject to any disclaimer, the term of this patent is extended or adjusted under 35 U.S.C. 154(b) by 595 days.

(21) Appl. No.: 11/716,225

(22) Filed: Mar. 9, 2007

(65) Prior Publication Data

US 2008/0217929 A1 Sep. 11, 2008

(51) Int. Cl.
*E05C 3/06* (2006.01)
*E05C 3/16* (2006.01)

(52) U.S. Cl. ..... 292/216; 292/DIG. 53; 292/DIG. 54

(58) Field of Classification Search ..... 292/216, 292/DIG. 53, DIG. 54
See application file for complete search history.

(56) References Cited

U.S. PATENT DOCUMENTS 4,703,961 A * 11/1987 Weinerman et al. ..... 292/216
4,896,906 A * 1/1990 Weinerman et al. ..... 292/48
5,046,340 A * 9/1991 Weinerman et al. ..... 70/208
5,069,491 A * 12/1991 Weinerman et al. ..... 292/48
5,439,260 A * 8/1995 Weinerman et al. ..... 292/48
5,564,295 A * 10/1996 Weinerman et al. ..... 70/208
5,586,458 A * 12/1996 Weinerman et al. ..... 70/208
5,884,948 A * 3/1999 Weinerman et al. ..... 292/216
6,454,321 B1 * 9/2002 Parikh ..... 292/216
6,471,260 B1 * 10/2002 Weinerman et al. ..... 292/216
6,651,467 B1 * 11/2003 Weinerman et al. ..... 70/208
6,942,259 B2 * 9/2005 Marzolf et al. ..... 292/216
7,055,874 B1 6/2006 Jeffries et al.
7,140,649 B1 * 11/2006 Gregory ..... 292/48
7,726,707 B2 * 6/2010 Simchayoff et al. ..... 292/216
2006/0006668 A1 * 1/2006 Hidding et al. ..... 292/216
* cited by examiner

*Primary Examiner* — Carlos Lugo
(74) *Attorney, Agent, or Firm* — Wood, Phillips, Katz, Clark & Mortimer

(57) ABSTRACT

A latch assembly combination having: a) a first plate assembly; b) first and second axles extending from the first plate assembly; c) a rotor mounted to one of the first and second axles for guided pivoting movement between latched and released positions; d) a catch mounted to the other of the first and second axles for guided pivoting movement between: i) an engaged position wherein the catch blocks the rotor in the latched position; and ii) a disengaged position wherein the rotor is allowed to reposition; e) a biasing assembly for urging the rotor toward the released position; and f) at least one of: i) a second plate assembly that can be selectively operatively joined to the first plate assembly in first and second different manners; and ii) third and fourth plate assemblies of different configuration that can be selectively operatively joined to the first plate assembly.

53 Claims, 26 Drawing Sheets

FIG. 12
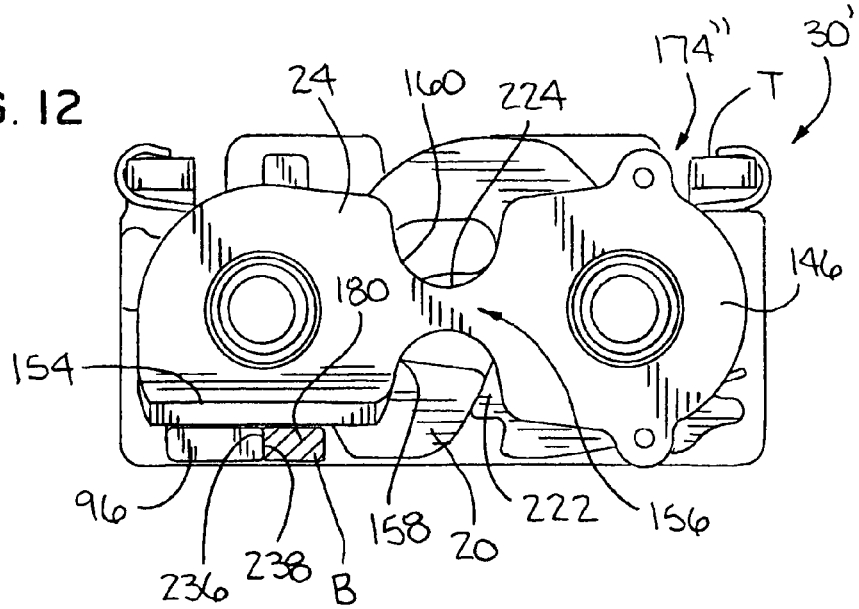
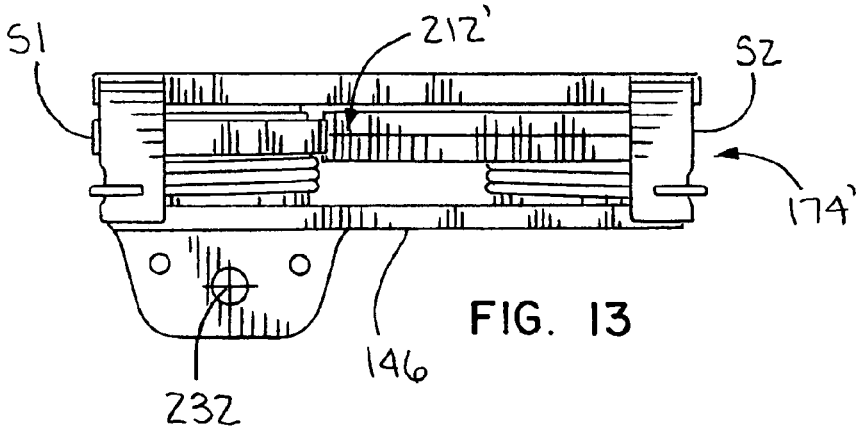
FIG. 13
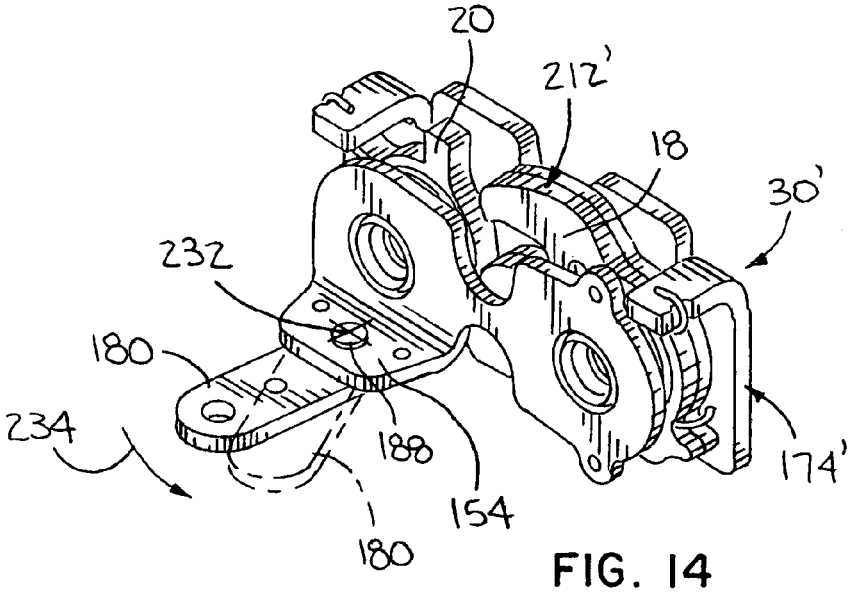
FIG. 14

FIG. 21
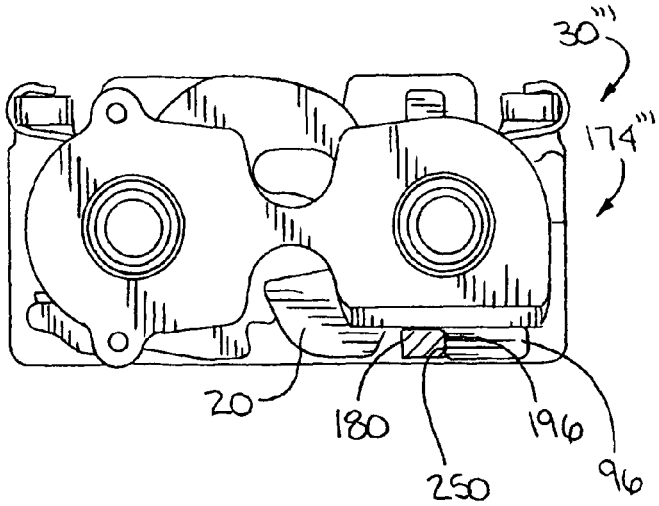
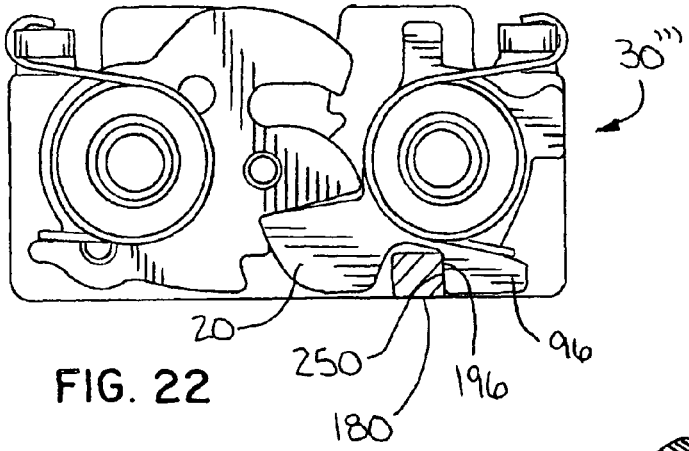
FIG. 22
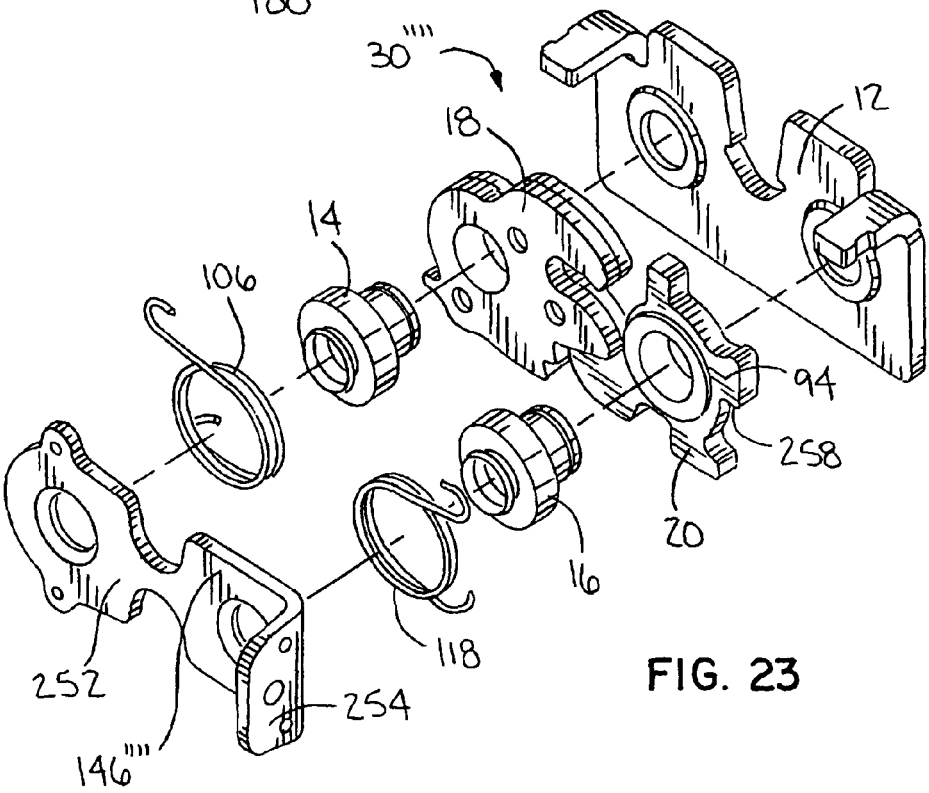
FIG. 23

FIG. 33
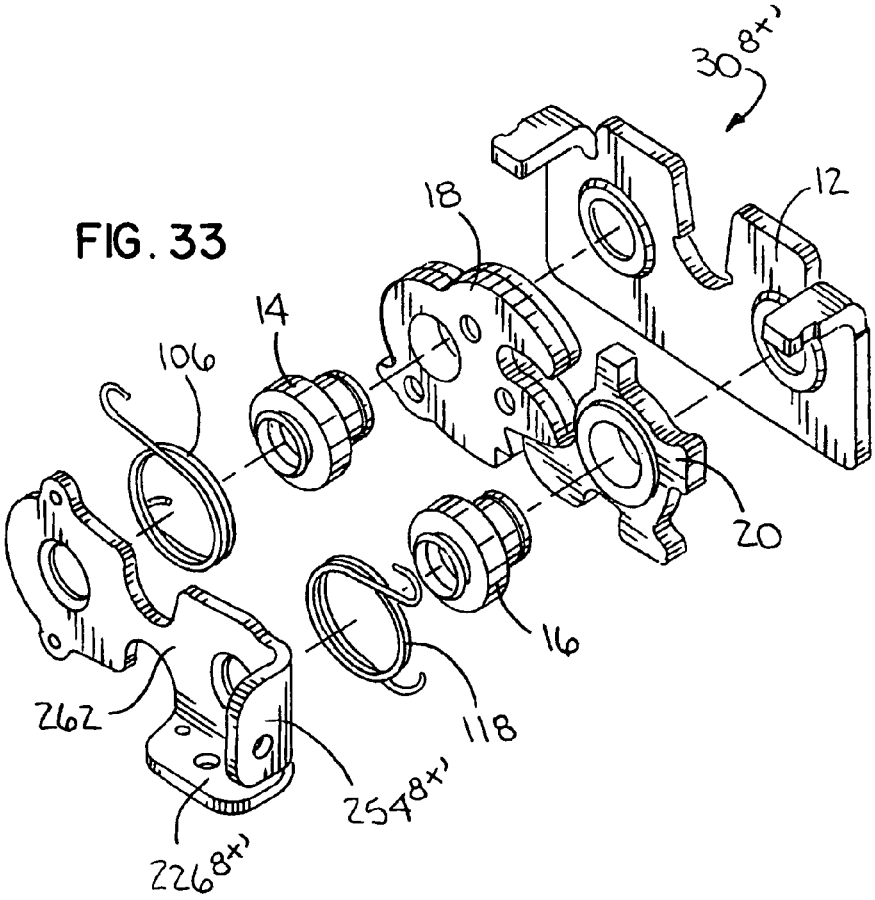
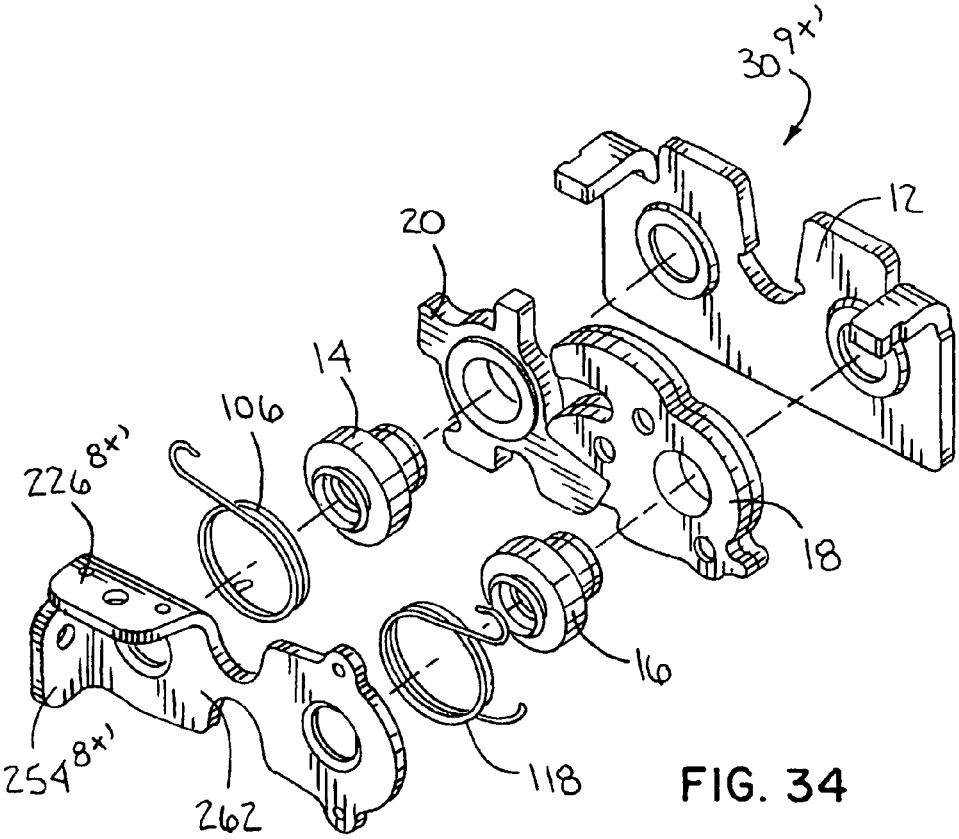
FIG. 34

FIG. 35
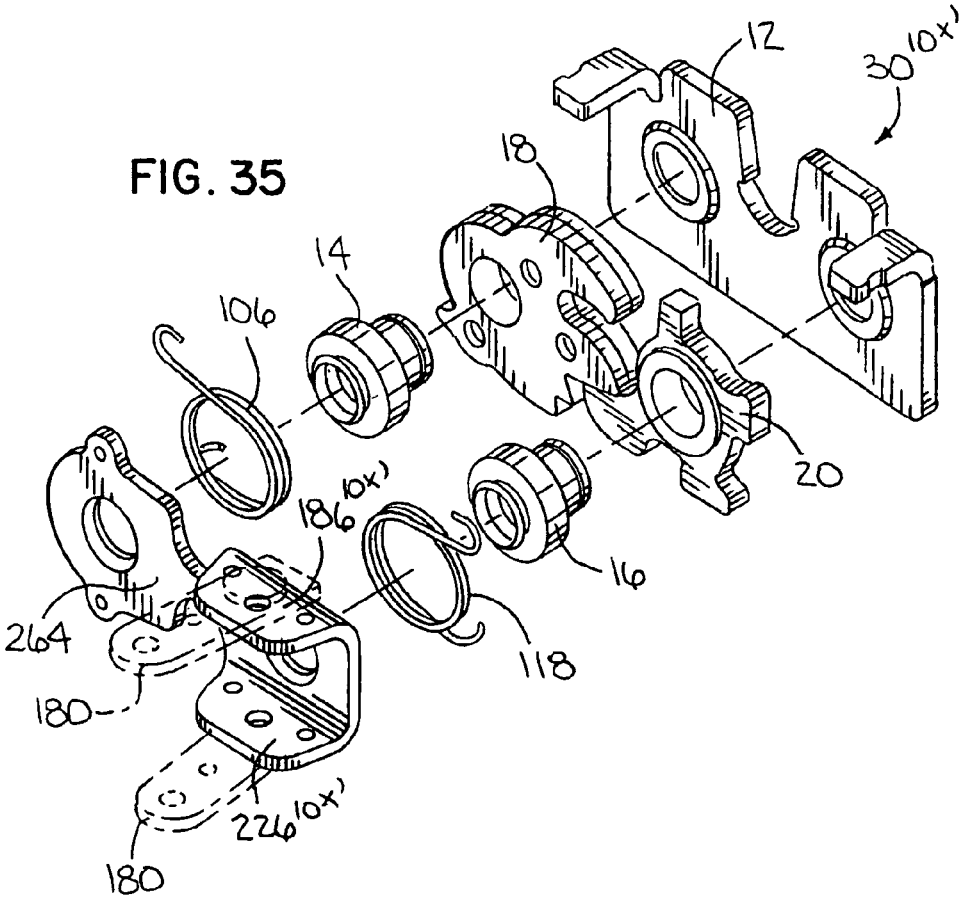
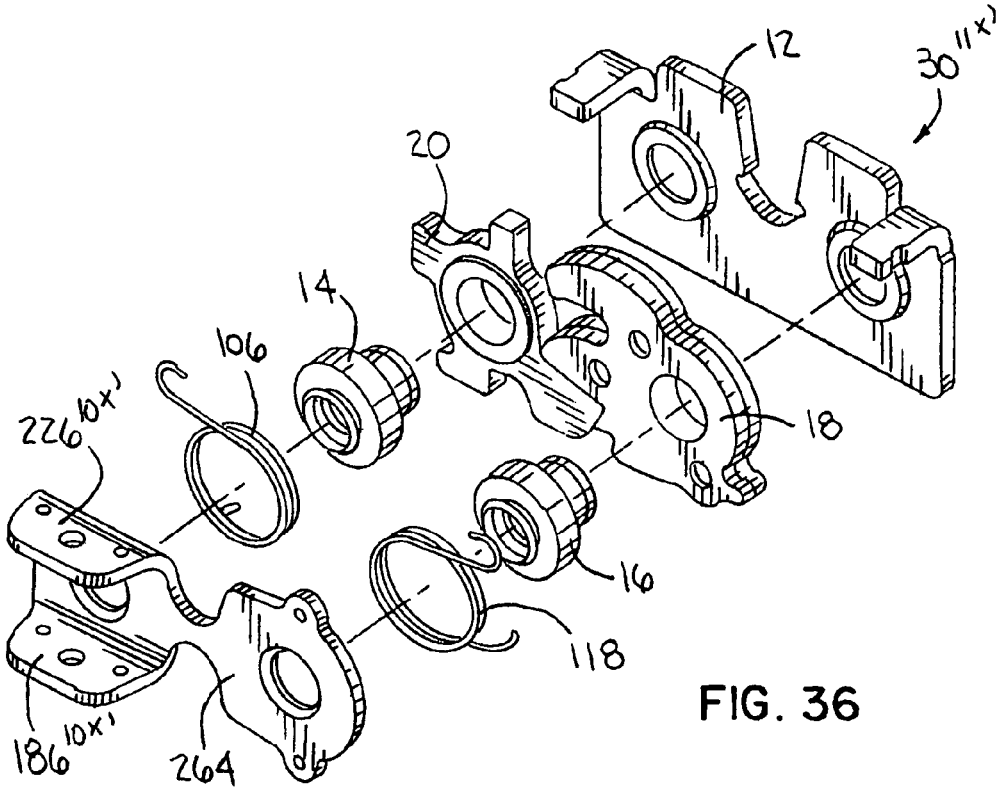
FIG. 36

FIG. 40
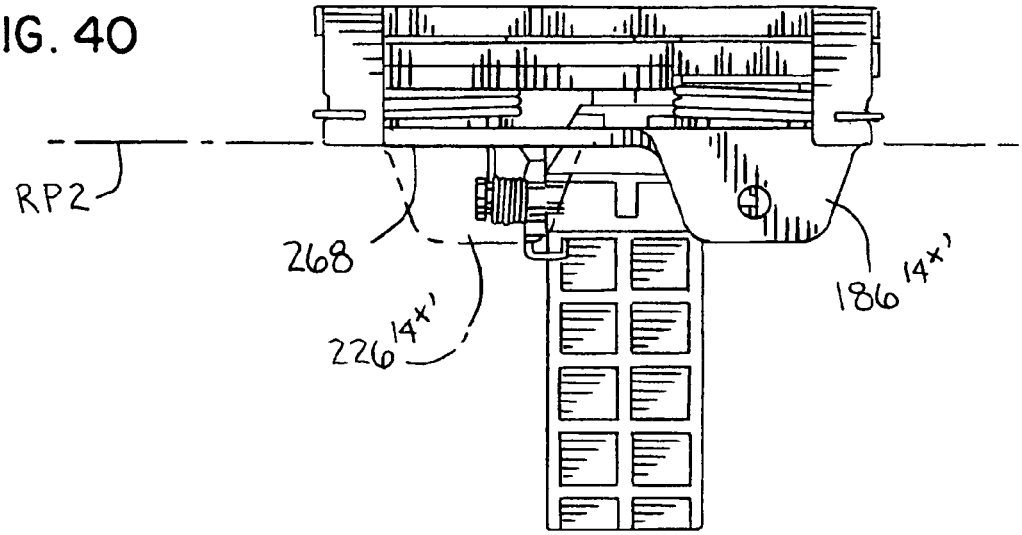
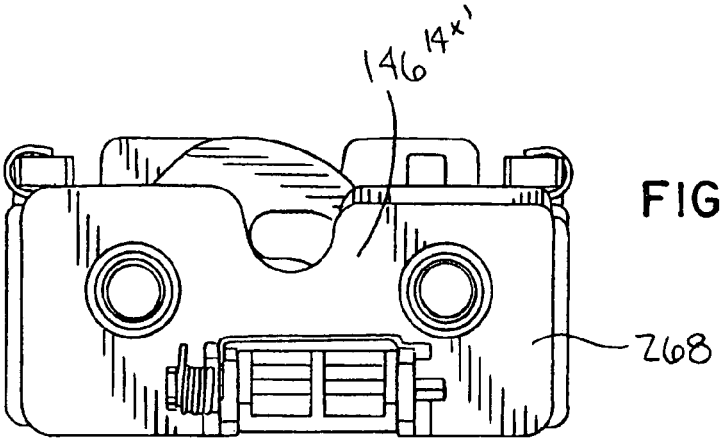
FIG. 41
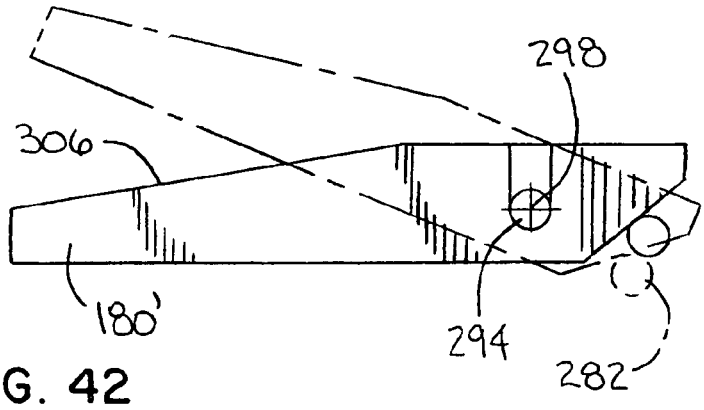
FIG. 42

FIG. 47
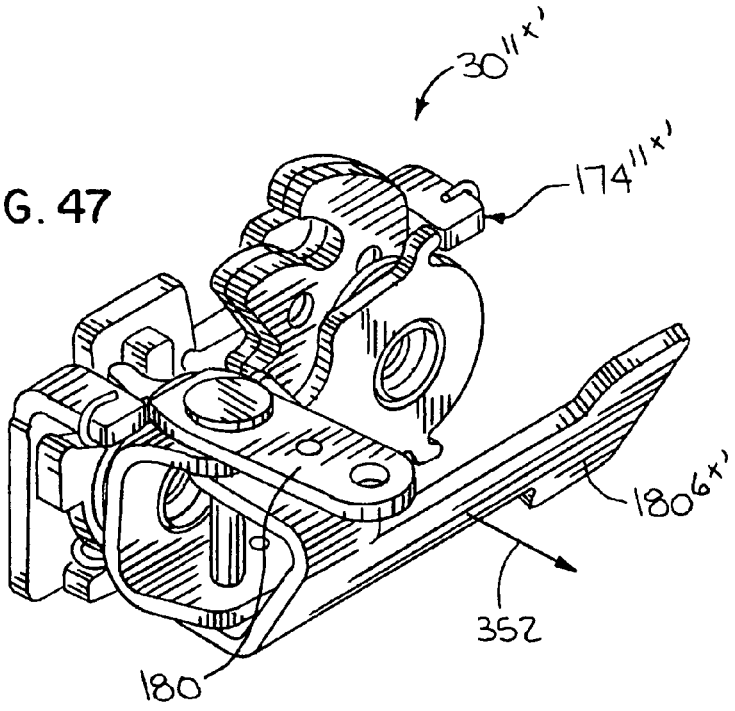
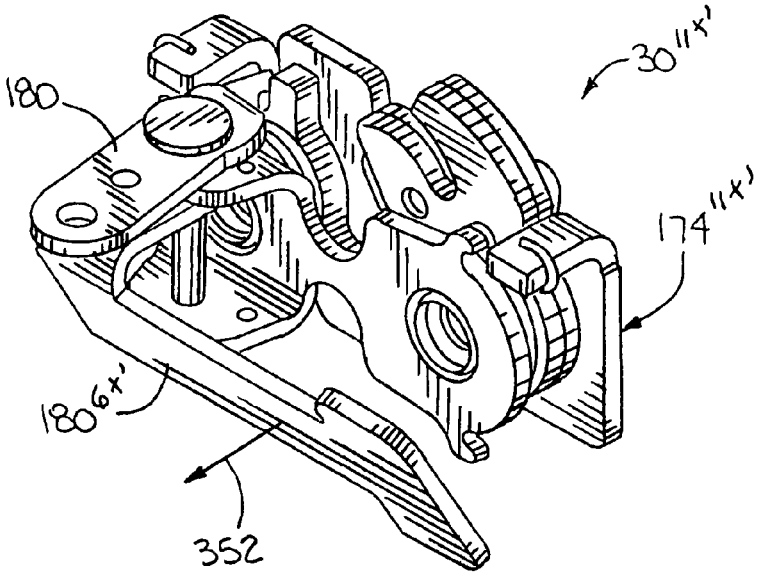
FIG. 48

LATCH ASSEMBLY WITH SELECTIVELY ASSEMBLED COMPONENTS

BACKGROUND OF THE INVENTION

1. Field of the Invention

This invention relates to latch systems for releasably maintaining a repositionable closure element in a predetermined position relative to a support therefor and, more particularly, to a latch assembly having a housing with a repositionable rotor thereon for engaging a strike element with the housing and strike element mounted one each on the support and closure element.

2. Background Art

There is a multitude of latch assemblies currently in existence that use a cooperating strike element and rotor to releasably maintain a movable element, such as a closure element, in at least one predetermined position, relative to a support upon which the closure element is mounted. This combination is used in many different industries and environments for both static and dynamic applications.

Typical of this construction is the use of a housing that supports cooperating rotor and catch components. The rotor is repositionable relative to the housing between a latched position and a released position and is spring biased normally towards the latter. As the closure element is moved towards the predetermined position therefor, the strike element interacts with the rotor and causes the rotor to be moved from the released position into the latched position, as an incident of which the strike element becomes captive in a receptacle defined by the rotor. A catch engages the rotor to maintain the rotor in the latched position and is repositionable to allow the rotor to be moved under the spring bias force back into the released position, whereupon the closure element can be moved out of the predetermined position therefor.

Typically, the basic components of the latch assembly are pre-assembled as a module that can be integrated into an actuating system that will ultimately be used to change the rotor from the latched position into the released position therefor. Suppliers of these types of systems encounter demands for myriad different module configurations, depending upon the mounting requirements and nature of the actuating system. As just examples, certain applications require left-handed operation while others require right-handed operation. Repositioning of the rotor through the actuating system may require the direct application of a force on an actuator element that is directly on the housing or upon an actuator assembly that is remote from the housing. The operation of the actuating system may be manually performed or may rely on powered components. Within each of these variations is a further subset of multiple different structures.

Heretofore, each latch assembly module has been custom designed. Latch assembly modules with specific characteristics and features are constructed using a dedicated supply of components, typically including: a) a specific housing; b) a pair of axles; c) a particular "handed" rotor; d) a particular "handed" catch; and e) one or more springs for producing the normal bias on the rotor. These components will normally be stocked in a manner that they can be serially picked and assembled on a dedicated line. Thus, each particular module configuration requires its own dedicated stock of components that is combinable in a consistent manner. Generally, the only components that are practically interchangeable, to be crossed over from one module design to the next, are the axles.

By reason of custom designing and assembling individual modules, there are a number of inherent inefficiencies, from the standpoint of tooling, required stocking and assembly space, manning of assembly lines and inventory control. Generally, manufacturers will keep on hand components for a particular module based upon anticipated demand. By doing so, orders can be filled promptly. However, demand for particular types of modules may fluctuate significantly, as result of which an excess of one particular design may be on hand while there is a shortage of another design. The only way to promptly meet customer demand is to keep on hand an excess of each different module design. This may lead to a significant stock of unused inventory. This is a problem not only from the standpoint of the financial investment, but also from the standpoint that the components and/or assembled modules must be stored.

Further, over time, demand for a certain design of module may decrease, whereupon the inventory of the particular design may remain stagnant and ultimately may have to be disposed of with significant financial consequences.

Also, as noted above, if the manufacturer offers, for example, ten different module constructions, ten different set-ups or lines may be required in the manufacturing facility. This may take up a significant amount of valuable facility space. Manning of these multiple lines may introduce other inefficiencies, potentially both from the standpoint of inefficient personnel time usage and excess personnel.

Aside from space and manning issues, the engineering, tooling and set-up costs increase with the number of parts and model variations. Preparatory to final design manufacture, each latch assembly version must be prototyped and tested to avoid potentially unforseen manufacturing or performance problems. All the above considerations potentially also lead to a delay in introducing a product to market.

The industry continues to seek out latch assembly designs that can be efficiently manufactured to allow suppliers to offer a line of high quality latch assembly products that meet a wide range of customer needs and demands at competitive pricing.

SUMMARY OF THE INVENTION

A latch assembly combination comprising: a) a first plate assembly; b) first and second axles extending from the first plate assembly and respectively having first and second axes; c) a rotor mounted to one of the first and second axles for guided pivoting movement around the axis of the one of the first and second axles between latched and released positions; d) a catch mounted to the other of the first and second axles for guided pivoting movement around the axis of the other of the first and second axles between: i) an engaged position wherein the catch blocks the rotor in the latched position; and ii) a disengaged position wherein the rotor is allowed to change from the latched position into the released; e) a biasing assembly for normally urging the rotor toward the released position; and f) at least one of: i) a second plate assembly that can be selectively operatively joined to the first plate assembly in first and second different manners to thereby cause the latch assembly to have first and second different operating characteristics; and ii) third and fourth plate assemblies of different configuration that can be selectively operatively joined, one in place of the other, to the first plate assembly to thereby cause the latch assembly to have third and fourth different operating characteristics. The second, third and fourth plate assemblies are selectively operatively joinable, one in place of the others, to the first plate assembly to allow selection of a desired operating characteristic for the latch assembly.

In one form, a first trip assembly with a first trip component is mounted to the second plate assembly for guided movement between: a) a normal position; and b) an actuated position. With the second plate assembly operatively joined to the first plate assembly, movement of the first trip component from the normal position into the actuated position causes the catch to be moved from the engaged position into the disengaged position.

In one form, the first trip assembly is part of a first actuating system including a first actuator assembly that is operable to cause the first trip component to be moved from the normal position into the actuated position.

In one form, the second plate assembly has first and second bores with first and second axes. With the second plate assembly operatively joined to the first plate assembly in the first manner, the first and second axes of the axles are respectively aligned with the first and second axes of the bores. With the second plate assembly operatively joined to the first plate assembly in the second manner, the first and second axes of the axles are respectively aligned with the second and first axes of the bores.

In one form, with the second plate assembly operatively joined to the first plate assembly in the first manner, the rotor is mounted to the first axle and the catch is mounted to the second axle. With the second plate assembly operatively joined to the first plate assembly in the second manner, the rotor is mounted to the second axle and the catch is mounted to the first axle.

In one form, the trip component is mounted to the second plate assembly in the same manner with the second plate assembly operatively joined to the first plate assembly in each of the first and second different manners.

In one form, the biasing assembly includes a first coil spring that cooperates between at least one of the first and second plate assemblies and the rotor with the second plate assembly operatively joined to the first plate assembly in the first manner to bias the rotor toward the released position. The same first coil spring cooperates between the at least one of the first and second plate assemblies and catch, with the second plate assembly operatively joined to the first plate assembly in the second manner, to bias the catch towards the engaged position.

In one form, the rotor has a receptacle for a strike element. The second plate assembly has first and second oppositely opening U-shaped receptacles. With the second plate assembly operatively joined to the first plate assembly in the first manner, the rotor receptacle aligns with the first U-shaped receptacle, and with the second plate assembly operatively joined to the first plate assembly in the second manner, the rotor receptacle aligns with the second U-shaped receptacle.

In one form, the first plate assembly, first and second axles and rotor are substantially the same with each of the second, third, and fourth plate assemblies operatively joined to the first plate assembly.

In one form, the biasing assembly includes at least one coil spring that is substantially the same with each of the second, third, and fourth plate assemblies operatively joined to the first plate assembly.

In one form, the first plate assembly consists of a flat wall with oppositely facing flat surfaces that are substantially parallel to each other and a first reference plane. The oppositely facing flat surfaces bound a first thickness. The first plate assembly further has first and second discrete tabs that project transversely to the first reference plane and define a support for the at least one coil spring.

In one form, the at least one coil spring consists of at least first and second coil springs. The first coil spring acts between the rotor and first discrete tab to urge the rotor towards the released position. The second coil spring acts between the catch and second discrete tab to urge the catch towards the engaged position.

In one form, the flat wall and first and second discrete tabs are formed as one piece.

In one form, the second plate assembly consists of a first flat wall with oppositely facing flat surfaces that are substantially parallel to each other and a first reference plane. The oppositely facing flat surfaces bound a first thickness. A first tab extends transversely to the first reference plane. The first trip component is mounted to the first tab for guided pivoting movement between the normal and actuated positions.

In one form, the first flat wall and first tab are formed as one piece.

In one form, the first tab projects from the first wall at a first location. The third plate assembly consists of a second flat wall with a shape generally similar to the first flat wall, including oppositely facing flat surfaces that are parallel to each other and a second reference plane. The third plate assembly has a second tab that is transverse to the second reference plane and is at a second location on the second flat wall that is different than a location on the second flat wall corresponding to the first location on the first wall.

In one form, the third plate assembly consists of a second flat wall with oppositely facing flat surfaces that are parallel to each other and a second reference plane. The third plate assembly has first and second tabs that are each transverse to the second reference plane and define a support for a second trip assembly with a second trip component that is mounted to the third plate assembly for guided movement between: a) a normal position; and b) an actuated position. With the third plate assembly operatively joined to the first plate assembly, movement of the first trip component from the normal position into the actuated position causes the catch to be moved from the engaged position into the disengaged position.

In one form, the second trip component is mounted directly to each of the first and second tabs for guided movement between the normal and actuated positions.

In one form, the second trip component is mounted directly to the first tab for guided movement between its normal and actuated position.

A third trip component may be provided that is mounted directly to the second tab for guided pivoting movement between: a) a normal position, and b) an actuated position. Movement of the third trip component from its normal position into its actuated position causes the catch to be moved from the engaged position into the disengaged position.

In one form, the third trip component is not mounted directly to the first tab.

In one form, there are different numbers of tabs on the second and third plate assemblies that project transversely respectively with respect to the first and second reference planes.

In one form, at least one of the rotor and catch is made from first and second different materials.

In one form, the at least one of the rotor and catch has a bore to receive one of the axles which guides the at least one of the rotor and catch in pivoting movement around the axis of the one of the axles. The bore in the at least one of the rotor and catch is bounded by a surface defined at least in part by the first material. The first material is of a nature that it causes the at least one of the rotor and catch and one axle to generate less noise by moving guidingly against each other than would the at least one of the rotor and catch if the at least part of the surface was defined by the second material.

In one form, the first material is at least one of: a) rubber; b) plastic; and c) a composite.

In one form, the at least one of the rotor and catch has an exposed surface defined by the second material and the first material covers only a part of the exposed surface.

In one form, the at least one of the rotor and catch has an exposed surface defined by the second material and the first material covers substantially the entirety of the exposed surface.

In one form, the second material comprises metal.

In one form, at least one of the rotor and catch has a bore bounded by a first surface that is guided against a second surface on one of the axles that extends into the bore. At least one of the first and second surfaces is defined by a first material that is applied over a second material and that has a tendency to prevent noise generation more effectively than the first material would as the first and second surfaces are moved guidingly against each other.

In one form, there are cooperating first and second surfaces, respectively on the rotor and catch, that interact to cause the catch in the engaged position to block the rotor in the latched position, At least one of the first and second surfaces is defined by a first material that is applied over a second material.

In one form, the first material tends to avoid noise generation more effectively than would the second material as the first and second surfaces interact.

In one form, a second trip assembly with a second trip component is mounted to the second plate assembly for guided movement between: a) a normal position; and b) an actuated position. With the second plate assembly operatively joined to the first plate assembly, selective movement of either of the first and second trip components from its normal position into its actuated position causes the catch to be moved from the engaged position into the disengaged position.

In one form, the catch has spaced first and second surfaces upon which the first and second trip components respectively act.

In one form, the latch assembly combination may further be provided in combination with an actuating system including an actuator assembly.

In one form, the first trip component defines an actuating assembly on an actuating system that is directly engagable and repositionable by a user.

In one form, the actuator assembly includes an actuator element that is operated remotely from the first trip component.

In one form, the latch assembly combination may further be provided in combination with a closure element, that is movable guidingly relative to a support between first and second positions, and a strike assembly with a strike element. The latch assembly and strike assembly are provided, one each in the support and closure element, and cooperate to releasably maintain the closure element in one of the first and second positions.

In one form, the rotor defines a receptacle for the strike element. The rotor and at least one of: a) the first plate assembly; and b) one of the second, third and fourth plate assemblies, that is operatively joined to the first plate assembly, cooperate to maintain the strike element in the rotor receptacle with the rotor in the latched position and the closure element in the one of the first and second positions.

In one form, the rotor and the first plate assembly and the one of the second, third, fourth plate assemblies, that is operatively joined to the first plate assembly, cooperate to maintain the strike element in the rotor receptacle with the rotor in the latched position and the closure element in the one of the first and second positions.

In one form, with the second plate assembly operatively joined to the first plate assembly, the first plate assembly and second plate assembly define a housing with a generally rectangular shape with a perimeter edge consisting of spaced length edge portions, spaced width edge portions, and a chamber within which the rotor and catch reside. The spaced length and width edge portions each has a perimeter dimension. The majority of the perimeter dimension of at least one of the length and width edge portions is open so that the chamber is exposed at the majority of the perimeter dimension of the at least one of the length and width edge portions.

In one form, the majority of the entire perimeter edge is open so that the chamber is exposed over the majority of the entire perimeter edge.

In one form, the strike element is in the form of a closed hoop.

In one form, the rotor is substantially the same with each of the second, third, and fourth plate assemblies operatively joined to the first plate assembly.

In one form, the catch is substantially the same with each of the second, third and fourth plate assemblies operatively joined to the first plate assembly.

In one form, the flat wall has an exposed perimeter edge with a perimeter length and a majority of the perimeter length resides between spaced planes within which the oppositely facing flat surfaces reside, and has the first thickness.

In one form, the first flat wall has an exposed perimeter edge with a perimeter length and a majority of the perimeter length resides between spaced planes within which the oppositely facing flat surfaces reside and has the first thickness.

BRIEF DESCRIPTION OF THE DRAWINGS

FIG. 12 is a front elevation view of the assembled latch assembly of FIG. 11;

FIG. 13 is a plan view of the latch assembly of FIG. 12;

FIG. 14 is a perspective view of the latch assembly in FIGS. 11-13;

FIG. 21 is a front elevation view of the assembled latch assembly of FIGS. 19 and 20;

FIG. 22 is a view as in FIG. 21 wherein the plate assembly, normally operatively joined to the first plate assembly, is removed;

FIG. 23 is an exploded perspective view of a further modified form of latch assembly, according to the present invention;

FIG. 33 is an exploded perspective view of a further modified form of latch assembly, according to the present invention;

FIG. 34 is an exploded perspective view of a further modified form of latch assembly, according to the present invention;

FIG. 35 is an exploded perspective view of a further modified form of latch assembly, according to the present invention;

FIG. 36 is an exploded perspective view of a further modified form of latch assembly, according to the present invention;

FIG. 40 is a plan view of the assembled latch assembly of FIG. 39;

FIG. 41 is a front elevation view of the latch assembly in FIGS. 39 and 40;

FIG. 42 is a side elevation view of a trip actuator on the latch assembly in FIGS. 39-41;

FIG. 47 is a perspective view of a latch assembly, similar to that in FIG. 46 and having an actuator assembly in the form of a pull handle;

FIG. 48 is a view of the structure in FIG. 47 from a different perspective;

DETAILED DESCRIPTION OF THE DRAWINGS

Figure 1:
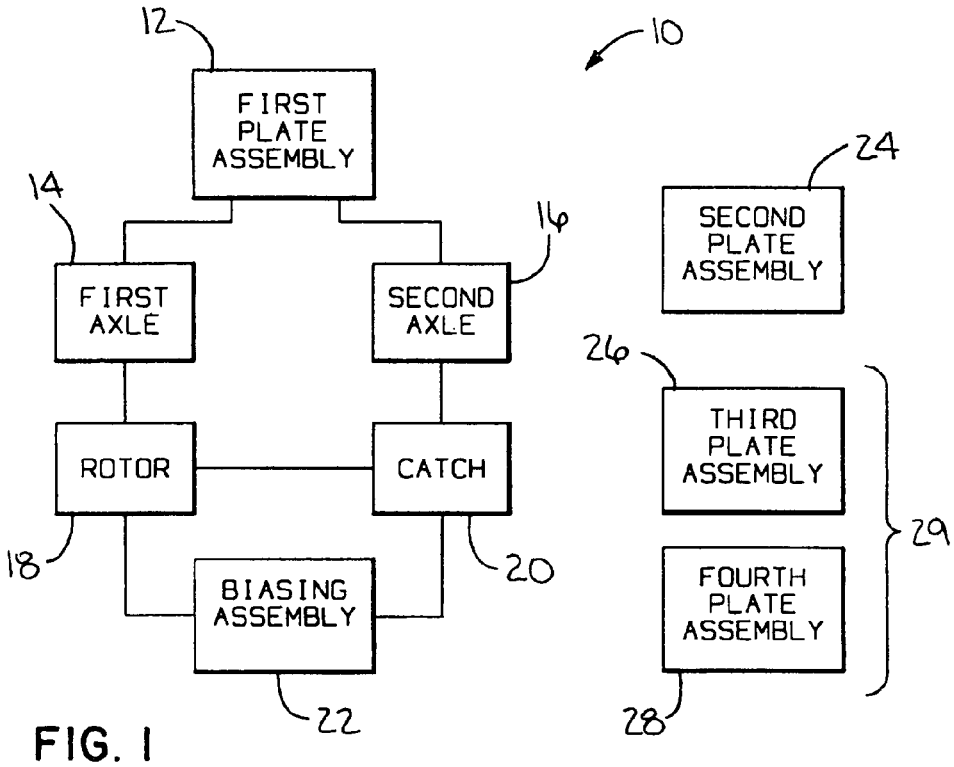
FIG. 1 is a schematic representation of a latch assembly combination, according to the present invention, and including a first plate assembly with various components thereon to which either: a) a second plate assembly can be operatively joined in different manners; or b) one of multiple plate assemblies of different configuration can be selectively operatively joined to select a desired operating characteristic for the resulting latch assembly.

As shown schematically in FIG. 1, the invention is directed to a latch assembly combination at 10 consisting of a first plate assembly 12 from which first and second axles 14, 16 extend. A rotor 18 is mounted to the first axle 14, with a catch 20 mounted to the second axle 16. The rotor 18 is guided by the first axle 14 in pivoting movement around the axis of the first axle 14 between latched and released positions. The catch 20 is similarly guided in pivoting movement by the second axle 16 around the axis of the axle 16 between: a) an engaged position wherein the catch 20 blocks the rotor 18 in the latched position; and b) a disengaged position, wherein the rotor 18 is allowed to change from the latched position into the released position. A biasing assembly 22 normally urges the rotor 18 towards the released position and the catch 20 towards an engaged position.

The latch assembly components are selectively combined to produce latch assemblies with different, desired operating characteristics. In one form, a second plate assembly 24 can be selectively operatively joined to the first plate assembly 12 in first and second different manners to thereby cause the resulting latch assembly to have first and second operating characteristics.

As an alternative to selecting the second plate assembly 24, a collection of third and fourth plate assemblies 26, 28, as shown at 29, can be made available. The third and fourth plate assemblies 26, 28 have different configurations, with one of the plate assemblies 26, 28 potentially having the same configuration as the second plate assembly 24. The third and fourth plate assemblies 26, 28 can be selectively operatively joined, one in place of the other, and the second plate assembly 24, to the first plate assembly 12 to thereby cause the resulting latch assemblies to have third and fourth different operating characteristics attributable to the incorporation of the third and fourth plate assemblies 26, 28, respectively.

Figure 2:
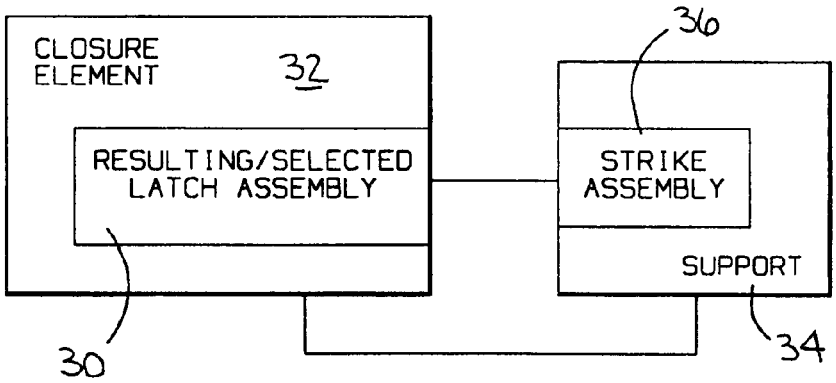
FIG. 2 is a schematic representation of one environment for the selected latch assembly made using a selected plate assembly from the combination in FIG. 1 and including a closure element with the selected latch assembly mounted thereon for cooperating with a strike assembly on a support relative to which the closure element is guidingly movable.

The second, third and fourth plate assemblies 24, 26, 28 are selectively and individually operatively joinable to the first plate assembly 12, one in plate of the others, to allow selection of a desired operating characteristic for the resulting latch assembly 30 (FIG. 2).

The latch assembly components are shown schematically in FIG. 1 in that the invention contemplates that the components could vary in configuration, as well as and in terms of how they interact with each other, over a wide range. The various embodiments that will be described hereinbelow are only exemplary of the many different structures contemplated by the invention.

As shown in FIG. 2, the resulting/selected latch assembly 30, incorporating one of the second, third, and fourth plate assemblies 24, 26, 28, is used in one application on a closure element 32 that is mounted for guided movement relative to a support 34 between first and second positions. One of these positions may be a closed position, but this is not necessary, nor is it necessary that the element 32 be technically a "closure" element. Through cooperation of the latch assembly 30 with a strike assembly 36 on the support 34, the closure element 32 can be releasably maintained in one of the first and second positions.

Figure 3:
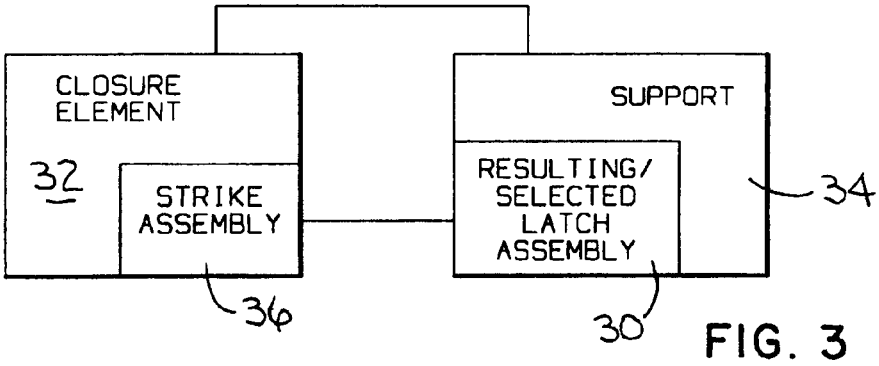
FIG. 3 is a schematic representation as in FIG. 2 wherein the latch assembly and strike element are interchanged with each other.

In an alternative form, shown in FIG. 3, the latch assembly 30 can be provided on the support 34, with the strike assembly 36 provided on the closure element 32. The interaction of the latch assembly 30 and strike assembly 36 is the same in FIG. 3 as in FIG. 2.

Figure 4:
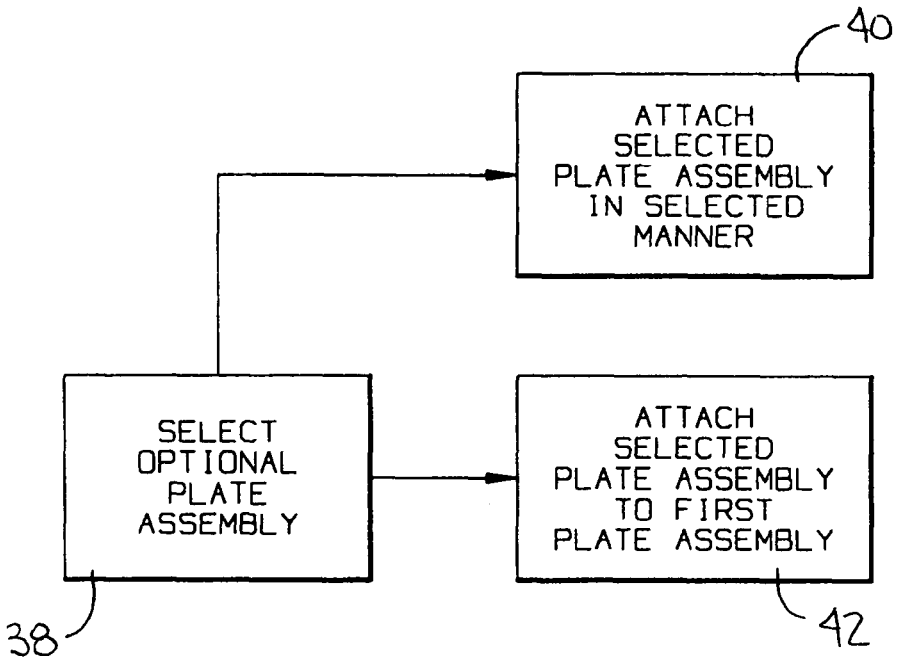
FIG. 4 is a schematic representation of a method of making a latch assembly by using one plate assembly in a selected manner or by selecting from plate assemblies having different configurations.

As shown in FIG. 4, the latch assembly combination 10 affords two primary options to the manufacturer, and potentially the end user. As shown at block 38, the user selects one of the second, third and fourth plate assemblies, 24, 26, 28 to be operatively joined to the first plate assembly 12. If the second plate assembly 24 is selected, as shown at block 40, the user operatively joins the second plate assembly 24 to the first plate assembly 12 in either of the first and second manners, thereby to select the desired first or second operating characteristic for the latch assembly 30.

As shown at block 42, if the user selects one of the third or fourth plate assemblies 26, 28, the same is operatively joined to the first plate assembly 12, thereby to cause the latch assembly to have either the third or fourth operating characteristic.

As explained in greater detail below, two latch assemblies are considered to have different operating characteristics and different configurations if there is any significant structural difference between the latch assemblies. As just examples, two latch assemblies have different operating characteristics if one is left-handed and the other is right-handed in operation. Similarly, two latch assemblies are considered to have different operating characteristics if the mounting locations of the rotor and catch are interchanged.

Essentially, if there is any structural distinction whereby two latch assemblies are not operable identically, these distinctions will be considered to cause the latch assemblies to have different configurations and operating characteristics.

Figure 5:
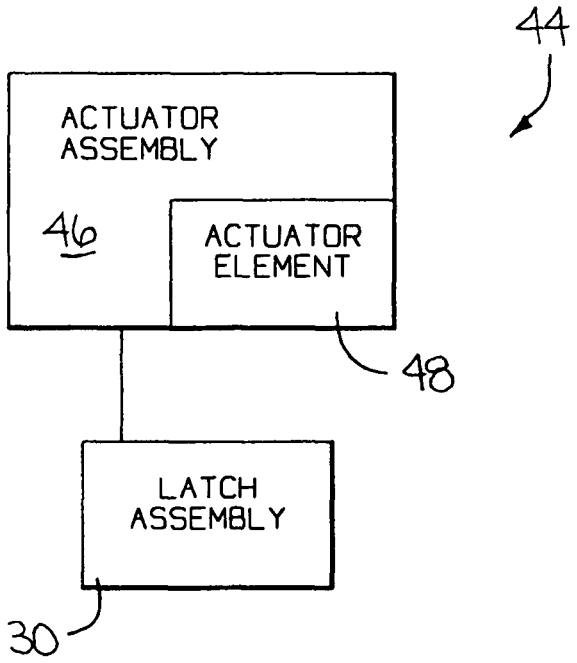
FIG. 5 is a schematic representation of a latching system including the inventive latch assembly.

As shown in FIG. 5, the latch assembly 30 is designed as a module that can be integrated as a self-contained unit into an actuating system 44. The actuating system 44 has an actuator assembly 46 that may directly interact with the latch assembly 30 to effect operation thereof. As just one example, the actuator assembly 46 may be integrated into the catch 20 so that an actuator element 48 thereon moves as one piece therewith and is directly engageable and operable by a user. Alternatively, the actuator assembly 46 may interact through a linkage, a cable, or other type of mechanism. The actuator assembly 46 may be manually operated or may be operated through one or more powered components. There may be wireless interaction of electrically operated components on the actuator assembly 46 and latch assembly 30. These are just examples of the universe of mechanisms contemplated.

As noted above, the actuator element 48 may be a part of the catch 20 on the latch assembly 30 to allow direct engagement and/or movement by a user. Alternatively, the actuator element 48 may be a push or pull handle, a mechanical push button, an electrical switch actuator, a button on a wireless actuator assembly, etc., each spaced from the latch assembly 30. These, again, are only examples of the many variations for the actuating system 44 contemplated by the invention.

Specific exemplary embodiments of the invention will now be described with respect to the remaining Figures herein. Referring initially to FIGS. 6-10, one specific form of latch assembly is shown at 30 consisting of the first plate assembly 12, the first axle 14 to which the rotor 18 is mounted for guided pivoting movement around the axle axis 50, the second axle 16 to which the catch 20 is mounted for guided pivoting movement around the axle axis 52, and the biasing assembly 22.

The axle 14 has a stepped diameter outer surface with a smaller diameter portion 54 and a larger diameter portion 56. The smaller diameter portion 54 extends through a bore 58 through the rotor 18 and is secured to the first plate assembly 12 within a bore 60 therethrough. The surface 62 surrounding the catch bore 58 is guided in pivoting movement around the axis 50 against and relative to the outer surface 64 of the smaller diameter portion 54 of the axle 14. The rotor 18 is axially captive between the first plate assembly 12 and a shoulder 66 defined at the transition between the smaller and larger diameter portions 54, 56.

The axle 16 may be identical to the axle 14 and has a smaller diameter portion 54', that is directed through a bore 68 in the catch 20 and secured to the first plate assembly 12 in a bore 69 therein. The rotor surface 70 bounding the bore 68 is guided in rotation against and relative to the outer surface 64' on the smaller diameter axle portion 54' around the axis 52. The rotor 20 is axially captive between the first plate assembly 12 and a shoulder 66' between the smaller diameter portion 54' and larger diameter portion 56' of the axle 16.

The basic arrangement of components and their operation are conventional in nature. Details of a latch assembly that operates in a similar manner are shown in U.S. Patent Publication No. US2006/0006668 A1, the disclosure of which is incorporated herein by reference.

Figure 6:
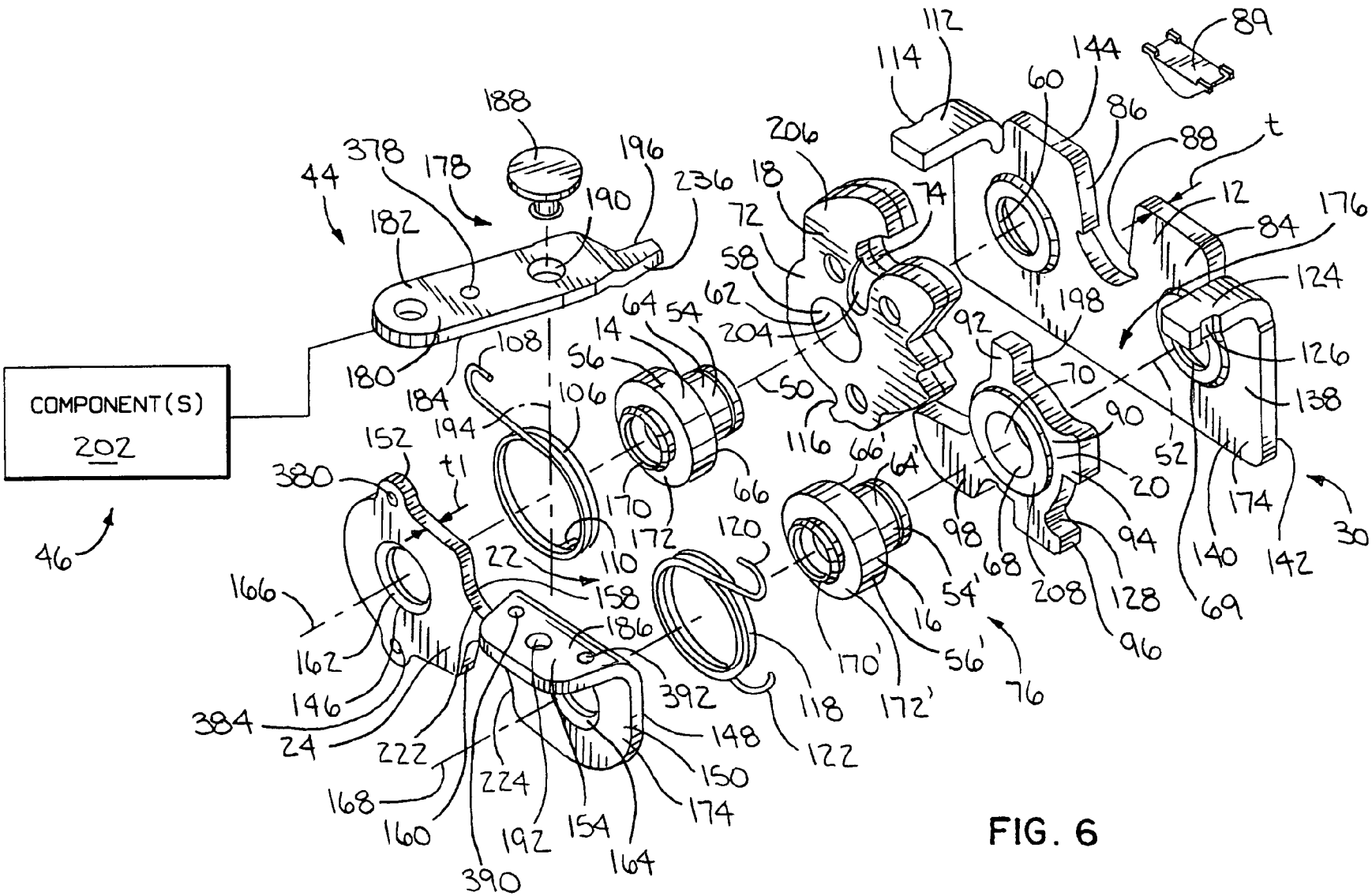
FIG. 6 is an exploded, perspective view of one form of latch assembly, made according to the present invention.
Figure 7:
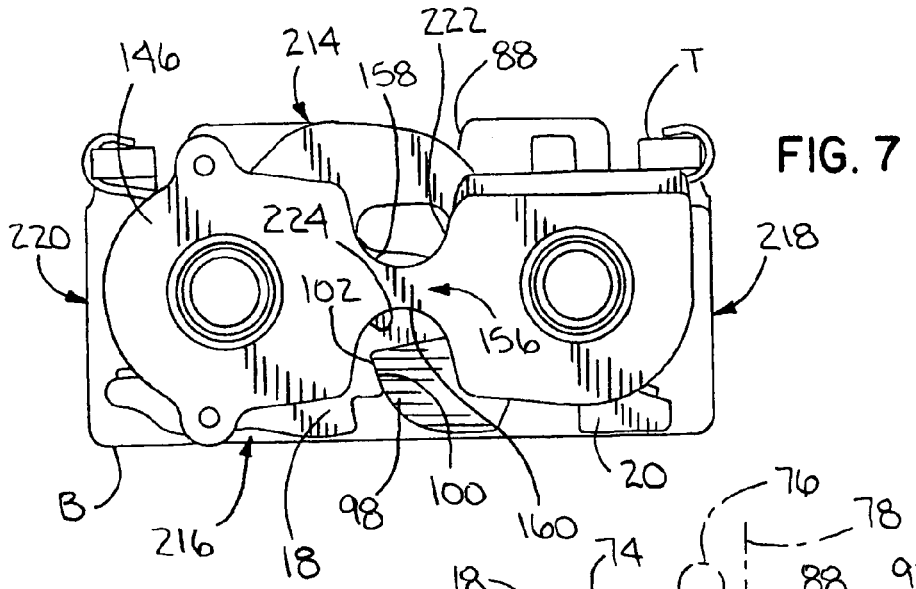
FIG. 7 is a front elevation view of the assembled latch assembly of FIG. 6.
Figure 9:
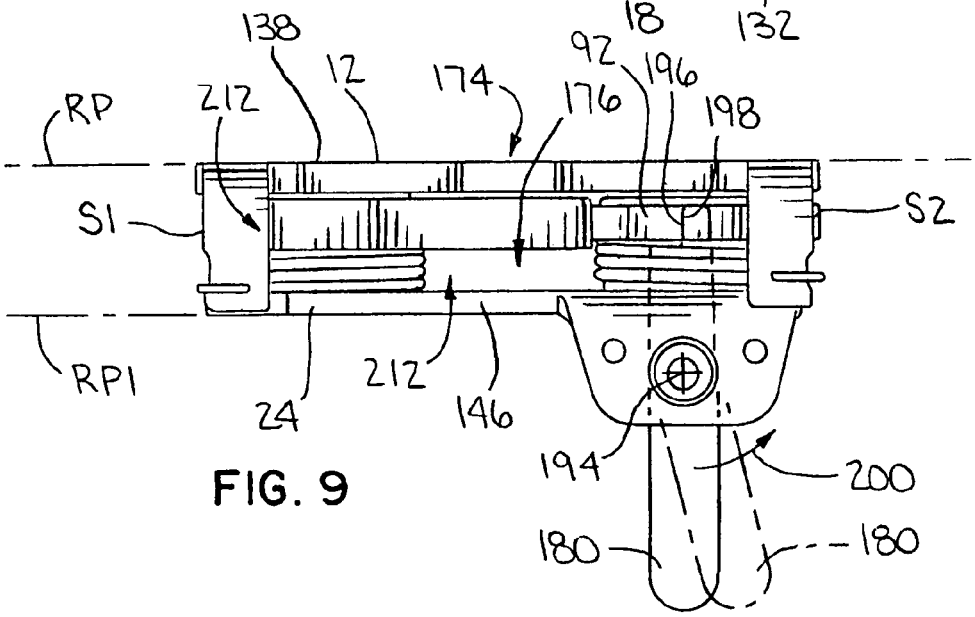
FIG. 9 is a plan view of the latch assembly in the FIG. 7 state.
Figure 11:
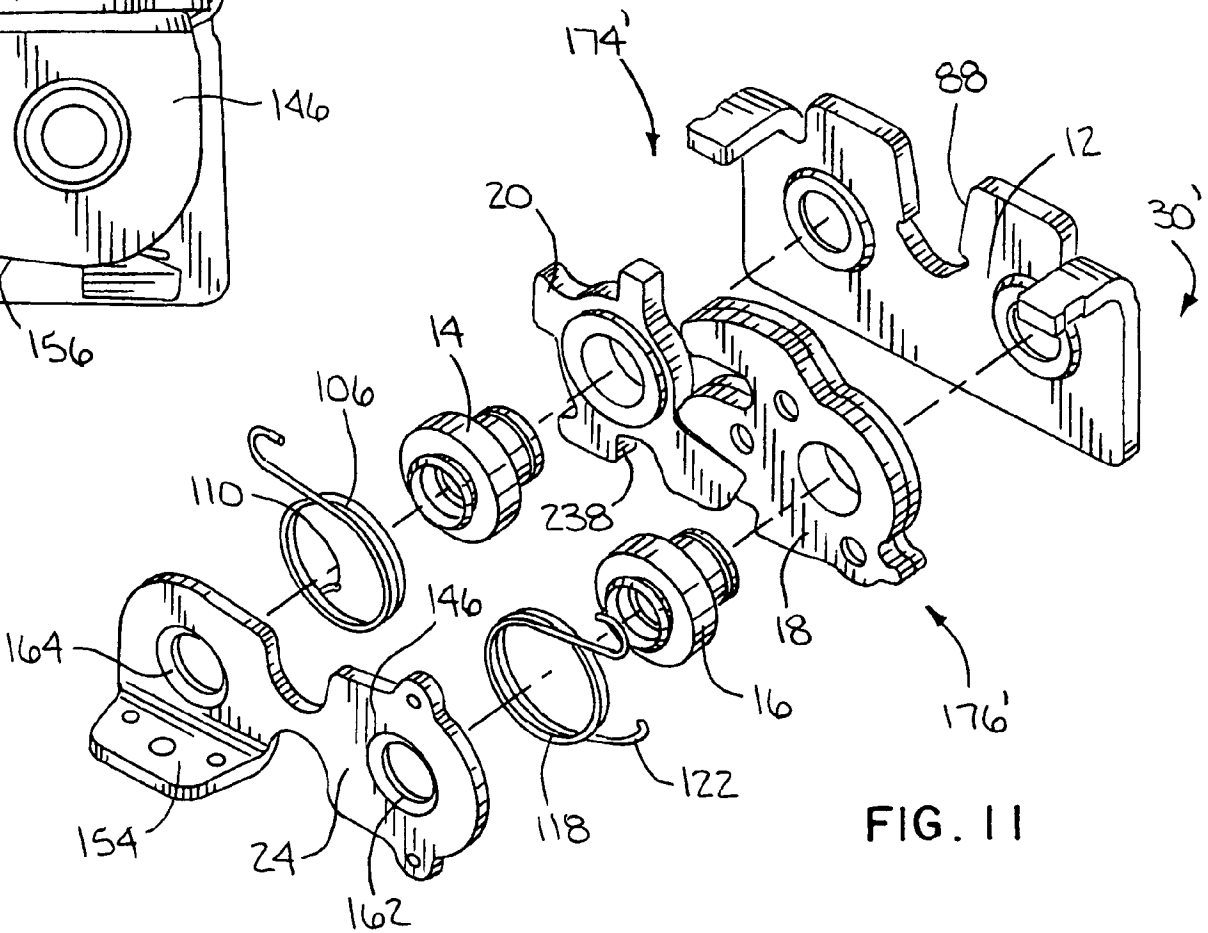
FIG. 11 is an exploded perspective view of a modified form of latch assembly, made according to the present invention and using the same second plate assembly as on the latch assembly of FIG. 6.
Figure 10:
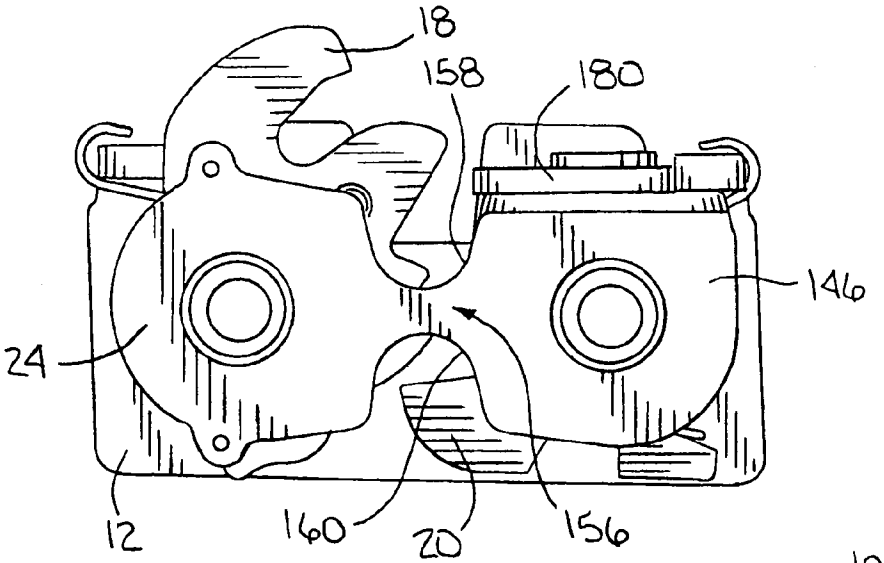
FIG. 10 is a perspective view of the latch assembly of FIG. 6 with the rotor in the released position.

Briefly, the rotor 18 has a body 72 that defines a U-shaped receptacle 74. The rotor 18 is pivotable between a latched position, as shown in FIGS. 7 and 9 and in solid lines in FIG. 8, and a released position, as shown in FIGS. 6 and 10 and in dotted lines in FIG. 8.

Figure 8:
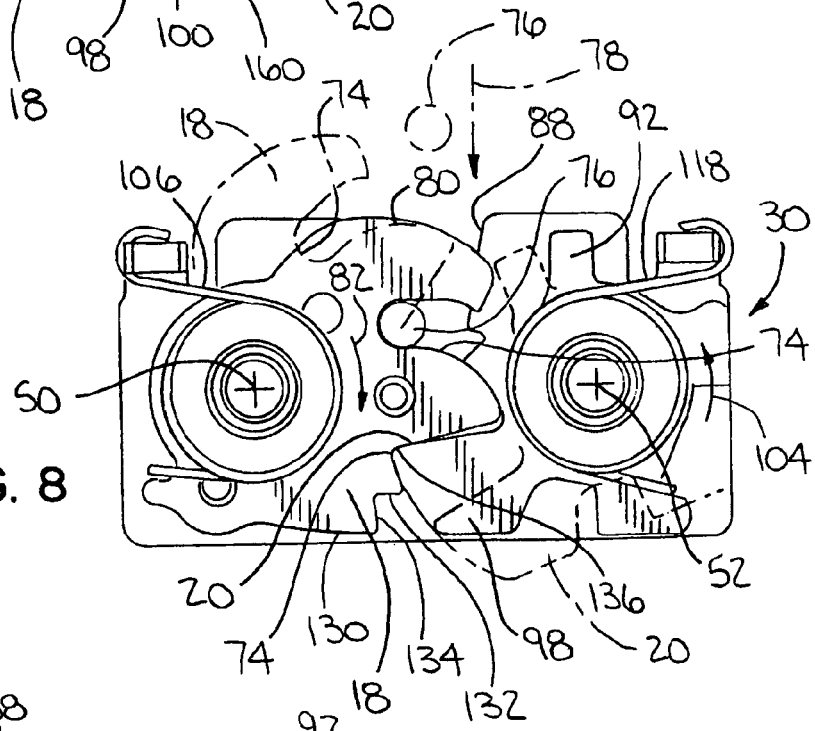
FIG. 8 is a view as in FIG. 7 with a second plate assembly, normally operatively joined to the first plate assembly, removed and with a rotor in a latched position and a catch in an engaged position in solid lines and the rotor in a released position and the catch in a disengaged position in dotted lines.

In operation, as relative movement takes place between the latch assembly 30 and a strike element 76 on the strike assembly 36, as shown for the exemplary arrangement in FIGS. 3 and 8, the strike element 76 moves in the direction of the arrow 78 in FIG. 8 to encounter a rotor surface 80 bounding the receptacle 74. Continued movement of the strike element 76 in the direction of the arrow 78 causes the rotor 18, initially in its released position, to be pivoted around the axis 50 in the direction of the arrow 82 towards, and eventually into, the solid line, latched position. In this rotor position, the strike element 76 resides at the base of the receptacle 74. As seen in FIG. 8, the receptacle 74 has an extended construction to accommodate vertical misalignment of the strike element 76 and rotor 18, as when there is sagging of the closure element 32. This feature is described more fully in pending application Ser. Nos. 10/386,350 and 10/421,045 and issued U.S. Pat. No. 6,942,259.

To accommodate the strike element 76, a flat wall 84 on the first plate assembly 12 has a receptacle/cutout 86 that is generally U-shaped. With the rotor in the latched position of FIG. 8, one surface 88 bounding the receptacle/cutout 86 blocks the receptacle 74 so that the strike element 76 cannot escape therefrom. An optional rubber pre-load block 89 can be pressed into, and frictionally held within, the base of the receptacle/cutout 86. The block 89 eliminates rattling of closure elements 32 with which the latch assembly 30 is associated that do not have a seal or striker load.

The catch 20 is designed to releasably maintain the rotor 18 in the latched position therefor. The catch 20 has a body 90 with four separate arms 92, 94, 96, 98, each projecting in cantilever fashion radially with respect to the axis 52. The multiple arm configuration makes the catch 20 usable in the same form in most embodiments herein.

The catch 20 is movable around the axis 52 between an engaged position, as shown in FIG. 7 and in dotted lines in FIG. 8, and a disengaged position, shown in dotted lines in FIG. 8. With the rotor 18 in the latched position and the catch 20 in the engaged position, facing surfaces 100, 102, respectively on the rotor 18 and catch 20, abut so as to block pivoting movement of the rotor 18 from its latched position back into its released position.

The catch 20 is changed from its engaged position into its disengaged position by pivoting movement of the catch 20 around the axis 52 in the direction of the arrow 104. By doing so, the surface 102 on the catch leg 98 clears the pivoting path of the rotor 18, which is thereby allowed to move from the latching position into the released position by pivoting movement opposite to the direction of the arrow 82 around the axis 50.

The rotor 18 is normally biased towards its released position by the biasing assembly 22. The biasing assembly 22 consists of a torsion coil spring 106 that surrounds the smaller diameter portion 54 of the axle 14. The coil spring 106 is pre-loaded with opposite hooked ends 108, 110, respectively engaged with the first plate assembly 12 and rotor 18. More particularly, the first plate assembly 12 has a tab 112 with an undercut 114 defining a seat for the hooked end 108. The opposite hooked end 110 engages within a U-shaped seat 116 formed in the rotor 18.

With the rotor 18 in the released position, the rotor 18 must be driven towards and into its latched position against the biasing torque produced by the spring 106. With the rotor 18 in the latched position and the catch 20 in the disengaged position and thereby cleared from the rotational path of the rotor 18, the force produced by the spring 106 is sufficient to drive the rotor 18 into its released position.

The catch 20 is similarly urged normally by the biasing assembly 22 into its engaged position. The biasing assembly additionally includes a second coil spring 118 with opposite hooked ends 120, 122. The hooked end 120 is engaged with the first plate assembly 12, with the hooked end 122 engaged with the catch 20. More particularly, the first plate assembly 12 has a second tab 124 with an undercut 126 that receives the hooked end 120. The catch arm 96 defines a U-shaped seat 128 for the end 122. The coil spring 118 is loaded to produce a resilient bias force that normally urges the catch 20 oppositely to the direction of the arrow 104 around the axis 52 and into the engaged position.

With the rotor 18 in the released position, the catch 20 is in the engaged position. As the rotor 18 is progressively urged against the force of the spring 106 towards and into the latched position, an edge 130 on the rotor 18 encounters the catch arm 98. Continued pivoting of the rotor 18 in the direction of the arrow 82 around the axis 50 causes the edge 130 to deflect the catch 20 in the direction of the arrow 104 around the axis 52 until the free end of the catch arm 98 aligns with a first receptacle 132 on the rotor 18. At this point, the catch 20, under the force of the spring 118, shifts slightly oppositely to the direction of the arrow 104 around the axis 52 so that the catch surface 102 abuts to a facing surface 134 on the rotor 18 bounding the receptacle 132. This represents a secondary engaged position for the catch 20 corresponding to a secondary latched state for the latch assembly 30. The provision of structure to allow the latch assembly 30 to be placed in a secondary latched position is not critical to the present invention.

Continued pivoting of the rotor 18 causes the catch 20 to further pivot against the force of the spring 118 in the direction of the arrow 104 until the free end of the catch arm 98 aligns with a separate receptacle 136, bounded by the surface 100. At this point, the spring 118 drives the catch 20 oppositely to the direction of the arrow 104 around the axis 52 to cause the surfaces 100, 102 to confront/abut, at which point the rotor 18 is in its primary latched position, the catch 20 is in the engaged position, and the latch assembly 30 is in a primary latched state.

In a preferred form, the first plate assembly 12 has a universal construction that can be used to mount all of the remaining components, including the selected second, third and fourth plate assemblies 24, 26, 28, and other plate assemblies as described herein. While not necessary, it is also preferred that some, and preferably all, of the rotor 18, catch 20, axles 14, 16 and springs 106, 118 have substantially the same, and preferably an identical, configuration that can be used with the first plate assembly 12 and each of the selected second, third and fourth plate assemblies 24, 26 28, and the other plate assemblies as described hereinbelow.

In a preferred form, the first plate assembly 12 consists of a flat wall 138 with oppositely facing flat surfaces 140, 142 that are parallel to each other and a reference plane RP (FIG. 9). The flat wall 138 has a uniform thickness of t between the surfaces 140, 142. The flat wall 138 has a generally rectangular configuration with an outer peripheral edge 144 having the uniform thickness t over a majority of its extent between spaced planes containing the surfaces 140, 142.

The tabs 112, 124 extend transversely, and substantially orthogonally, with respect to the reference plane RP at spaced locations on the flat wall 138. In a preferred form, the flat wall 138 and tabs 112, 124 are made from a single formed piece of metal.

The second plate assembly 24 consists of a flat wall 146 with a generally rectangular overall shape, at least nominally matched to that of the flat wall 138 on the first plate assembly 12, and oppositely facing flat surfaces 148, 150 that are substantially parallel to each other and a reference plane RP1 (FIG. 9). The flat wall 146 has a thickness t1 between the surfaces 148, 150. The second plate assembly 24 has an outer peripheral edge 152, the majority of which has the thickness t1 residing within the space bounded by planes containing the surfaces 148, 150. The peripheral edge 152 is interrupted only by a tab 154 that extends transversely to the reference plane RP1, preferably making an angle of approximately 90° therewith.

The flat wall 146 has a generally hourglass shape with a reduced width midportion at 156 defining oppositely opening, U-shaped receptacles 158, 160. The flat wall 146 has through bores 162, 164 with central axes 166, 168, respectively, that are spaced from each other by a distance equal to that between the axle axes 50, 52. The bores 162, 164 are designed to each receive a free end 170, 170' on the axles 14, 16, respectively.

The second plate assembly 24 is operatively joined to the first plate assembly 12 on the latch assembly 30 in a first manner to thereby cause the latch assembly 30 to have first operating characteristics. In this first manner, the axle end 170 projects through the bore 162, with the axle end 170' extending similarly through the bore 164. Through the axle ends 170, 170', the flat wall 146 is captively maintained against axially facing surfaces 172, 172', respectively on the axles 14, 16. Through this arrangement, the axles 14, 16 securely fix the first and second plate assemblies 12, 24 together so that they cooperatively define a rectangular housing 174 with a chamber 176 therebetween within which the operating components are mounted in operative relationship, as hereinabove described. The housing 174 provides the foundation for the operating components of the latch assembly 30 and is part of a self-contained module that can be integrated as a self-contained unit into the actuating system 44.

While the housing 174 can be mounted in different orientations whereby the designations "top", "bottom", etc. become arbitrary, for purposes of reference herein, the housing 174, and other housings described hereinbelow, will be considered to have spaced sides (S1, S2), each of which is open, a top (T) and a bottom (B).

In this embodiment, the actuator assembly 46 consists of a trip assembly 178 with a trip component 180 that is designed to directly interact with the catch 20 to change the position thereof. The trip component 180 has a body 182 with an elongate, flat shape. The trip component 180 is mounted at a first location on the second plate assembly 24 at which the tab 154 is formed to reside at the housing side S2 with the second plate assembly 24 operatively joined to the first plate assembly 30 in a first manner to produce the depicted latch assembly 30. A flat surface 184 on the trip component body 182 is placed facially against an upwardly facing flat surface 186 on the tab 154. A pin/rivet 188 extends through bores 190, 192, respectively in the trip component 180 and tab 154, so as to thereby mount the trip component 180 for guided pivoting movement relative to the tab 154 around an axis 194. As seen in FIG. 9, the trip component 180 is pivotable about the axis 194 between a normal position, as shown in solid lines in FIG. 9, and an actuated position, as shown in dotted lines in that same Figure.

The trip component 180 has an actuating edge 196 that is engageable with an edge 198 on the catch arm 92. In the normal position for the trip component 180, the edge 196 is adjacent to the edge 198 on the catch arm 92, with the catch 20 in its engaged position. By pivoting the trip component 180 around the axis 194 in the direction of the arrow 200, from the solid line/normal position into the dotted line/actuated position of FIG. 9, the actuating edge 196 on the trip component 180 interacts with the catch edge 198 so as to drive the catch 20 around the axis 52 in the direction of the arrow 104 from its engaged position into its disengaged position.

The trip component 180 may be directly operated by a user, whereby it functions as the actuator element on the actuating assembly 46, or may cooperate with another component or components 202, that perform the function of the actuator assembly 46 on the actuating system 44.

In FIGS. 11-14, the second plate assembly 24 is shown operatively joined to the first plate assembly 12 in a second manner to cause the resulting latch assembly 30' to have different operating characteristics than the latch assembly 30. With this configuration, the latch assemblies 30, 30' are different by reason of being different "handed".

In accomplishing this reconfiguration, the latch assembly 30' uses the exact same components as the latch assembly 30, including the first plate assembly 12, the rotor 18, the catch 20, the first and second axles 14, 16, the coil springs 106, 118, and the second plate assembly 24.

The rotor 18 and catch 20 on the latch assembly 30' are axially reversed, but cooperate in precisely the same manner as they do in the latch assembly 30. However, the mounting locations of the rotor 18 and catch 20 are reversed such that the catch 20 is mounted on the first axle 14 with the rotor 18 mounted on the second axle 16. The springs 106, 118 are mounted to the first plate assembly 12 identically as in the latch assembly 30, but with the hooked ends 110, 122 respectively engaging the catch 20 and rotor 18 rather than the rotor 18 and catch 20, as on the latch assembly 30.

The second plate assembly 24 faces in the same axial direction with respect to the first plate assembly 12 on both latch assemblies 30, 30' but is rotated on the latch assembly 30' through 180° so that the first axle 14 extends through the bore 164, with the second axle 16 extending through the bore 162. The connection between the first plate assembly 12 and second plate assembly 24 is carried out in precisely the same manner as on the latch assembly 30 to produce a housing 174'.

The same trip component 180 can likewise be utilized on the latch assembly 30' and is connected to the tab 154 to interact with the catch 20 in precisely the same manner as it does on the latch assembly 30. The location of the tab 154 is changed from a location at the top T and side S2 for the latch assembly 30, to the bottom B and side S1 for the latch assembly 30'.

Accordingly, by rearranging the components, and in particular the second plate assembly 24, catch 20 and rotor 18, the operating characteristics of the latch assembly 30' are different than those of the latch assembly 30. In a preferred form, all of the parts are identical and are interchangeable between the two latch assemblies configurations 30, 30'. However, this is not a requirement. It is preferred that at least the first plate assembly 12 be common to both latch assemblies 30, 30' as a foundation for supporting the other components. By making the same rotor 18 and catch 20 interchangeable, additional advantages are realized. Since the axles 14, 16 are the same, it is likewise preferred that they be used in both configurations.

Other features can be incorporated into the latch assemblies 30, 30', as hereinafter described. In one form, a sound deadening material is used on surfaces that interact between: a) the rotor 18 and catch 20 and axles 14, 16; and b) rotor 18 and catch 20. It is preferred that each of the rotor 18, catch 20 and axles 14, 16 be made from a durable metal base material, such as steel. One or both of the interacting surfaces on these components can be coated, at least over a portion thereof, with a material that has a tendency to prevent noise generation more effectively than the base metal defining the rotor 18, catch 20 and axles 14, 16. This coating material may be rubber, plastic, composite, etc.

For the exemplary rotor 18, shown in FIG. 6, the base metal material has an exposed surface 204 that is fully covered by a coating 206 of a dissimilar material that has a low coefficient of friction, between that material and that of cooperating parts, and good sound deadening properties. Also in FIG. 6, the catch 20 is shown with a base material with a plastic overmold 208 which bounds the bore 68.

Figure 15:
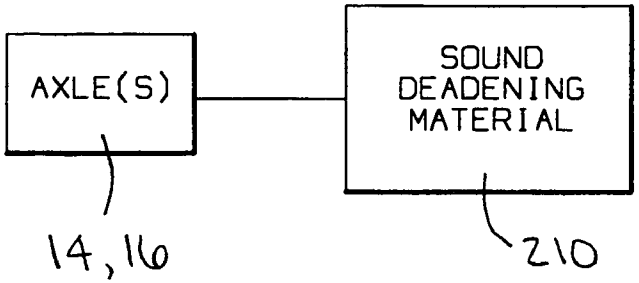
FIG. 15 is a schematic representation of axles on the inventive latch assemblies upon which sound deadening material is applied.

While not shown in the specific embodiments, as shown in FIG. 15 in schematic form, the axles 14, 16 have surfaces on which sound deadening material 210 may be applied, that may be the aforementioned rubber, plastic, composite, etc. The surfaces may be partially or fully coated.

By reason of having the coating on the rotor 18, the rotor surface 100 that interacts with the catch surface 102 absorbs the impact when the surfaces collide, whereby there is less noise generation as basic operation of the latch assembly takes place.

By making the rotor 18 and catch 20 from two different materials with different properties, significant flexibility is afforded in terms of how these components can be designed to minimize operating noise, without compromising performance. This two material design can be used on all latch assemblies described herein.

By reason of making the housings 174, 174' using the first and second plate assemblies 12, 24, the chambers 176, 176' are exposed over the majority of the extent of the peripheral edges 212, 212', respectively on the housings 174, 174', between the plate assemblies 12, 24. The chamber 176 in the exemplary latch assembly 30 is blocked only where the tabs 112, 124 bridge the chamber 176. While it is preferred that the majority of the extent of the peripheral edge 212 not be blocked, this is not a requirement. It is, however, preferred that at least a majority of the length of at least one of the length portions 214, 216 and width portions 218, 220 of the peripheral edge 212 be open so that the chamber 176 is exposed thereat. With the chamber 176 exposed over a majority of the length of the peripheral edge 212, foreign matter will not accumulate to interfere with component interaction or overall operation of the latch assembly 30.

The second plate assembly 24 can function to cooperate with the rotor 18 to confine the strike element 76 in the rotor receptacle 74 with the second plate assembly 24 mounted in either orientation on the latch assemblies 30, 30'. That is, on the latch assembly 30, a surface 222 bounding the receptacle 158, as seen in FIG. 7, is situated to block the strike element 76 in the rotor receptacle 74 in conjunction with the surface 88, bounding the receptacle/cutout 86. With the first plate assembly 12 on the latch assembly 30', the surface 224 bounding the receptacle 160 performs this same blocking function. This is made possible by the hourglass shape of the flat wall on the second plate assembly 24 produced by the reduced width at 156.

On the latch assembly 30, the surface 88 of the first plate assembly 12 and surface 222 on the second plate assembly 24 act on opposite axial sides of the rotor 18 to block the strike element 76 within the receptacle 74. The surface 88 on the first plate assembly 12 and surface 224 on the second plate assembly 24 cooperate to perform this same blocking function on the latch assembly 30'.

Whereas the latch assemblies 30, 30' have different operating characteristics made possible by mounting the second plate assembly 24 in two different manners/orientations, the invention also contemplates that there can be selection of different operating characteristics by reason of making available plate assemblies, such as the plate assemblies 26, 28, having different configurations that account for the different operating characteristics of the latch assemblies into which they are incorporated. Any number of plate assemblies having different configurations, that account for different operating characteristics when incorporated into the latch assemblies, may be provided. A manufacturer or end user that assembles the latch assembly selects and incorporates the plate assembly that provides the desired latch assembly operating characteristics.

While the collection of latch assemblies 29 (FIG. 1) identifies only third and fourth plate assemblies 26, 28 from which a selection is made, the collection 29 may actually be made up of the second plate assembly 24 together with the third plate assembly 26 and/or the fourth plate assembly 28, and/or any other combination of different interchangeable plate assemblies. The designations "first", and "second", etc. have no significance and are but arbitrary designations to distinguish different assemblies.

Figure 16:
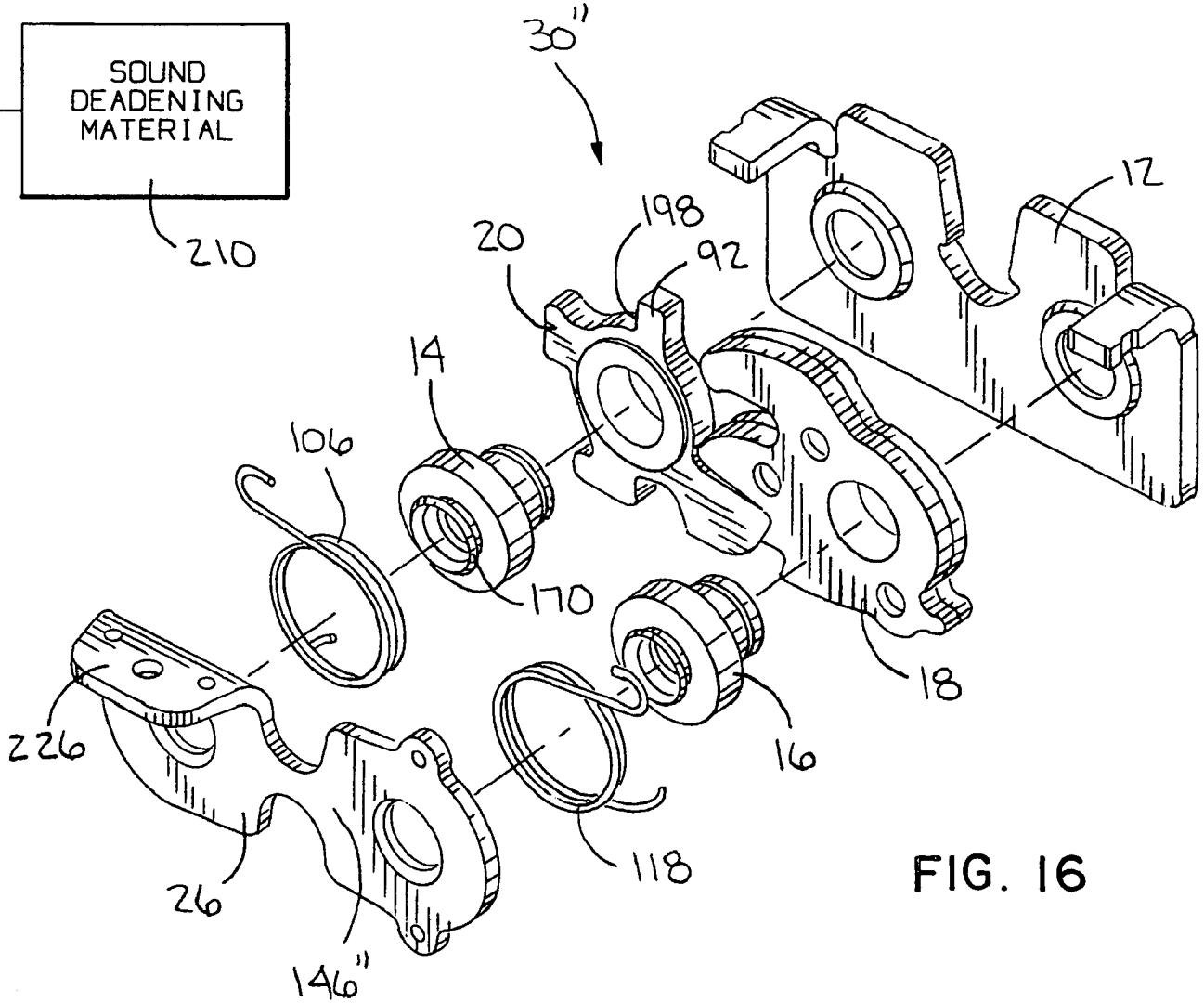
FIG. 16 is an exploded, perspective view of a further modified form of latch assembly, according to the present invention.
Figure 17:
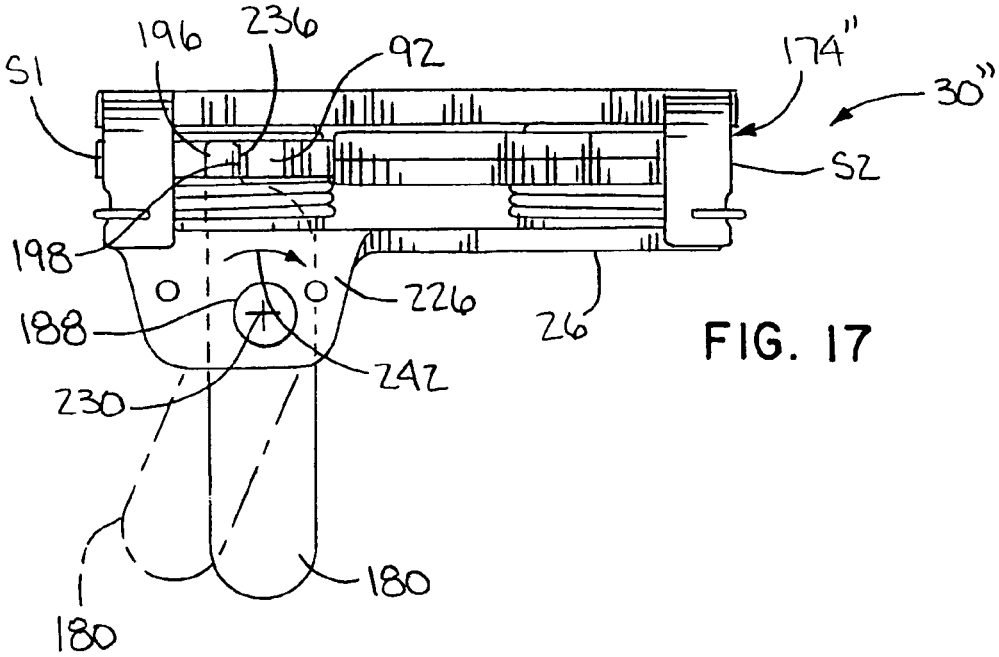
FIG. 17 is a plan view of the assembled latch assembly of FIG. 16.
Figure 18:
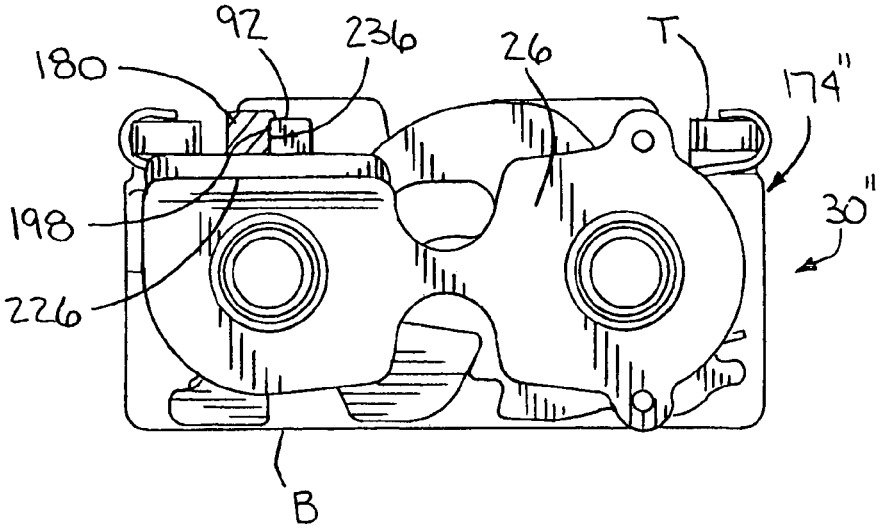
FIG. 18 is a front elevation view of the latch assembly in FIGS. 16 and 17.
Figure 19:
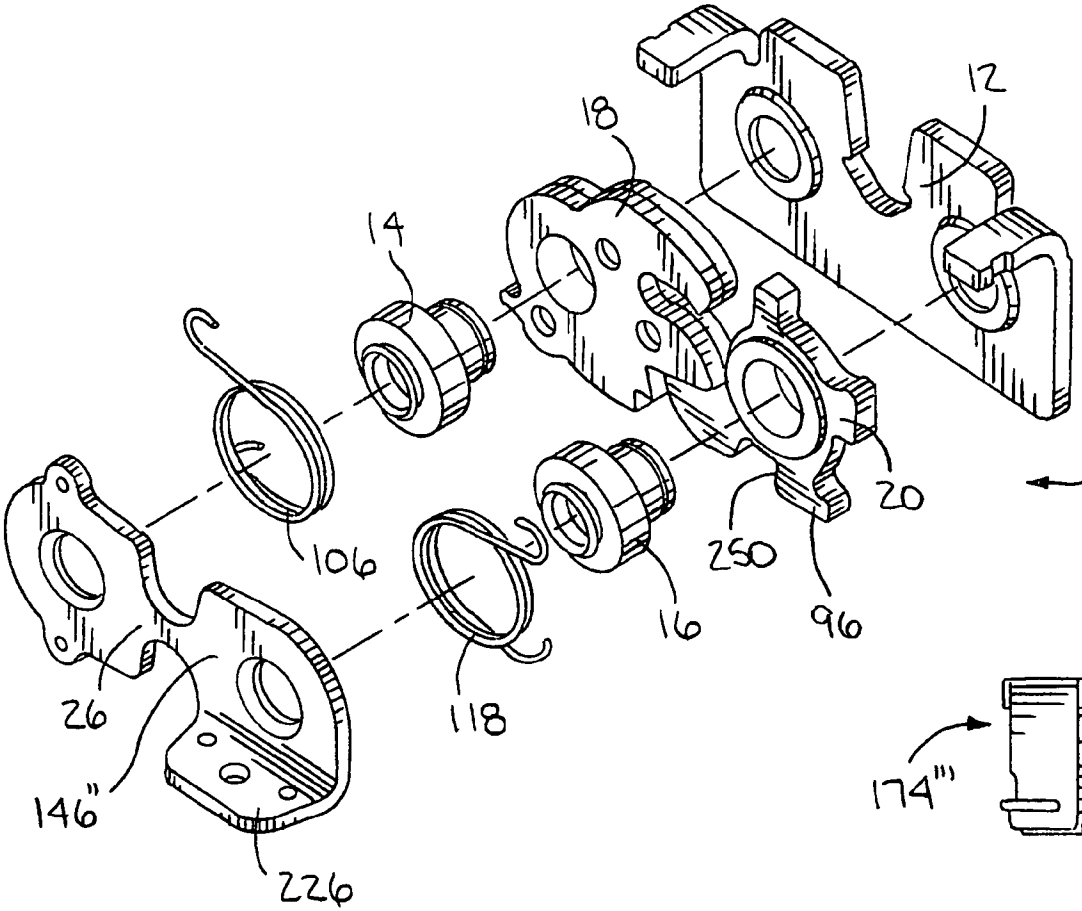
FIG. 19 is an exploded perspective view of a further modified form of latch assembly, according to the present invention.

An exemplary form of the "third" plate assembly 26 is shown in FIGS. 16-18 incorporated into a latch assembly at 30". The latch assembly 30" uses the first plate assembly 12, rotor 18, catch 20, axles 14, 16, and coil springs 106, 118 in the same arrangement as shown for the latch assembly 30' in FIGS. 11-14. Instead of using the second plate assembly 24, the third plate assembly 26 is used. The third plate assembly 26 has a flat wall 146" with substantially the same general shape as the flat wall 146. That is, the flat wall 146" is generally rectangular and flat with an "hourglass" shape. The only difference between the third plate assembly 26 and the second plate assembly 24 is the location of a tab 226 for supporting the trip component 180. The tab 226 on the latch assembly 30" is located at the top T and the side S1 of the housing 174" versus the bottom B and side S1 where the tab 154 is located on the latch assembly 30'. The latch assemblies 30', 30" have different operating characteristics by reason of the different locations of the tabs 154, 226 thereon for supporting the trip component 180.

Through the same pin/rivet 188, the trip component 180 is mounted to the tab 226 for pivoting movement about an axis 230 between a normal position, as shown in solid lines in FIG. 17, and an actuated position, as shown in dotted lines in that same Figure.

With the latch assembly 30', the trip component 180 pivots about an axis 232, defined by the pin/rivet 188, in the direction of the arrow 234 in FIG. 14. As this occurs, the edge 236 on the trip component 180, facing oppositely to the actuating edge 196, bears against an edge 238 on the catch arm 96 to move the catch 20 from the engaged position into the disengaged position.

With the latch assembly 30", the trip component 180 is pivoted in an opposite direction around the pin axis 230, as indicated by the arrow 242, to change the catch 20 between the engaged and disengaged positions. As this occurs, the actuating edge 236 on the trip component 180 bears against the edge 198 on the catch arm 92 to effect repositioning of the catch 20 between the engaged and disengaged positions.

Thus, the trip component 180 is mounted at a different corresponding location on the housing 174" than on the housing 174'. Additionally, the pivoting direction of the trip component 180 to move the catch 20 from the engaged position into the disengaged position is reversed for the two latch assemblies 30', 30".

In FIGS. 19-22, another latch assembly is shown at 30'". The latch assembly 30'" uses the first plate assembly 12, rotor 18, catch 20, axles 14, 16 and springs 106, 118. The latch assembly 30'" uses the same third plate assembly 26, that is reversed by being turned through 180°, the same as the second plate assembly 24 is reversed on the latch assemblies 30, 30'. The rotor 18 and catch 20 are axially reversed from the FIG. 15 orientation and interchanged with each other so that they are respectively journalled for rotation on the axles 14, 16. By reversing the third plate assembly 26 from its orientation on the latch assembly 30", the location of the tab 226 changes from: a) the top T and side S1, to b) the bottom B and side S2 of the housing 174'".

Figure 20:
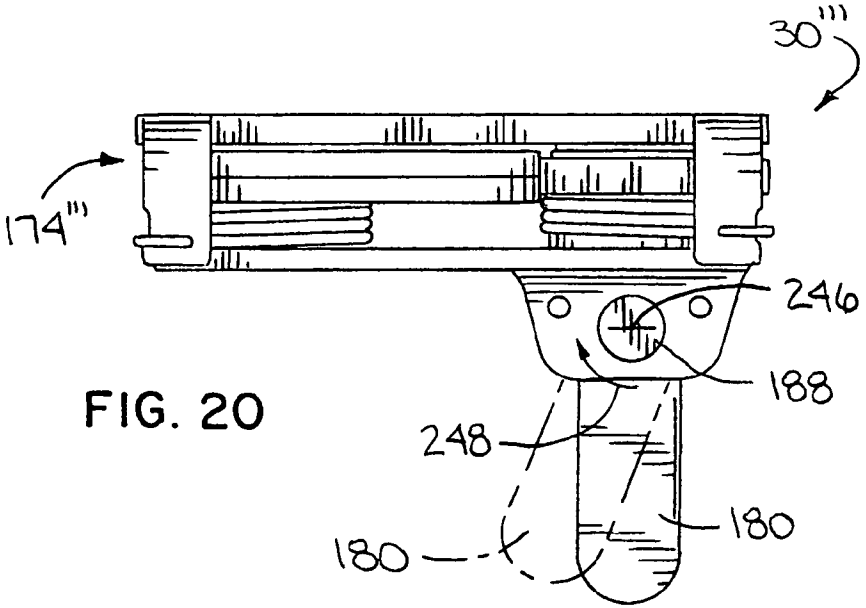
FIG. 20 is a plan view of the assembled latch assembly of FIG. 19.
Figure 24:
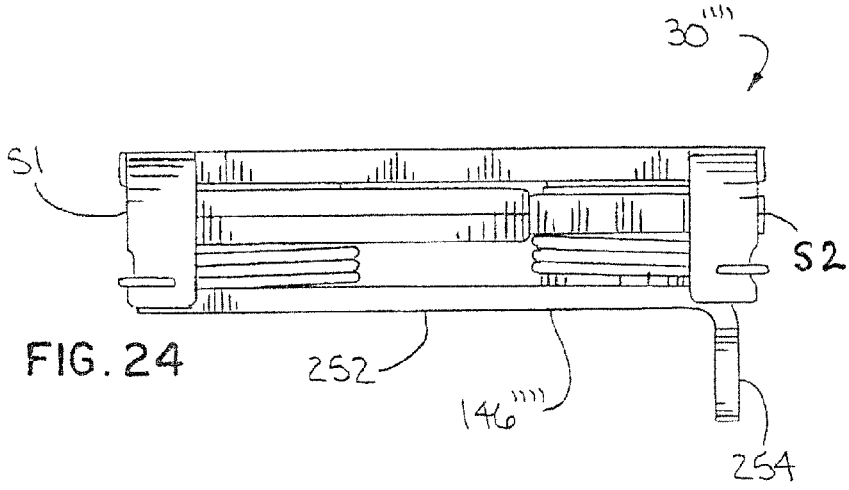
FIG. 24 is a plan view of the assembled latch assembly of FIG. 23.
Figure 25:
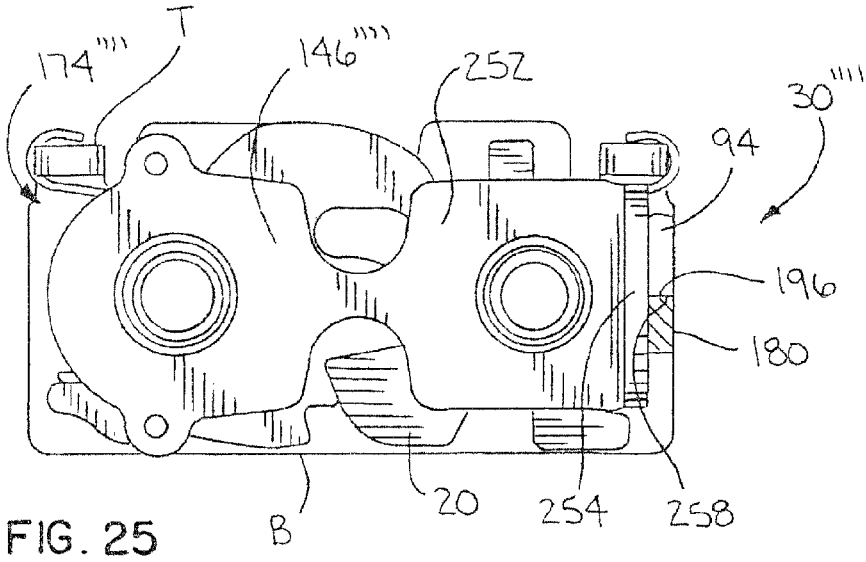
FIG. 25 is a front elevation view of the assembled latch assembly in FIGS. 23 and 24.
Figure 26:
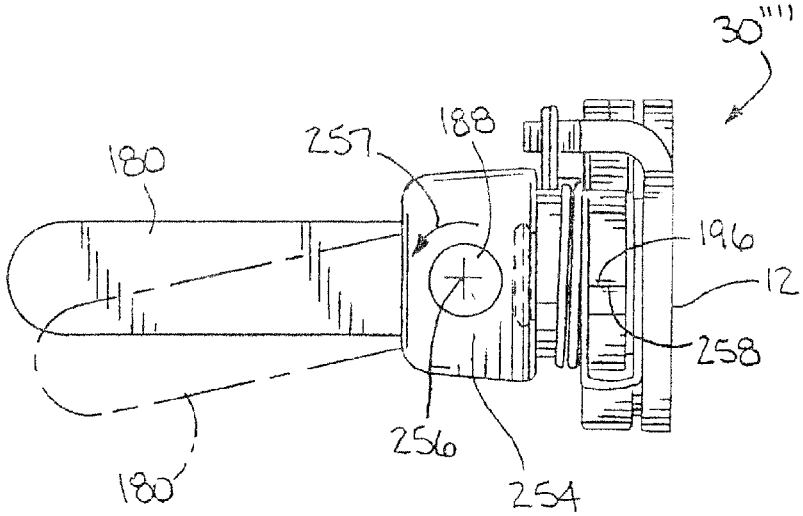
FIG. 26 is a side elevation view of the assembled latch assembly in FIGS. 23-25.
Figure 27:
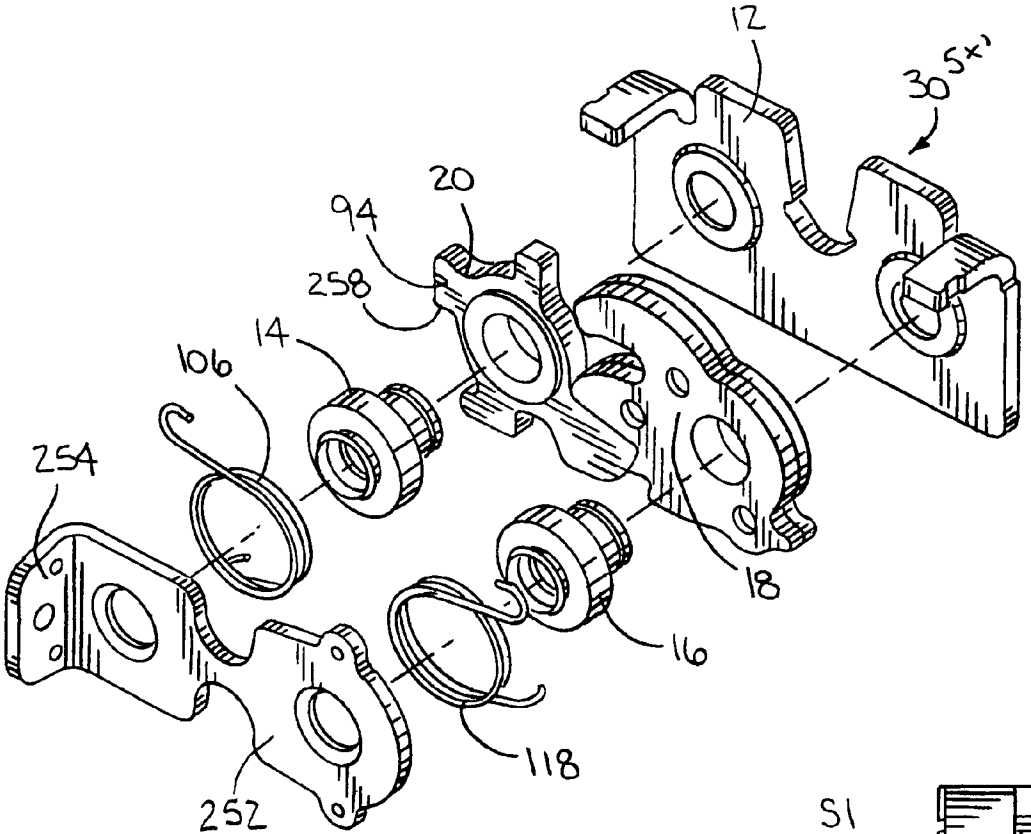
FIG. 27 is an exploded perspective view of a further modified form of latch assembly, according to the present invention.
Figure 28:
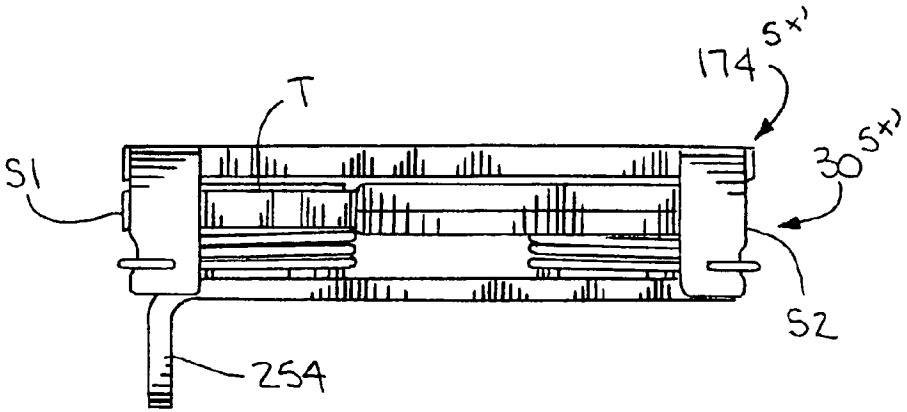
FIG. 28 is a plan view of the assembled latch assembly of FIG. 27.
Figure 29:
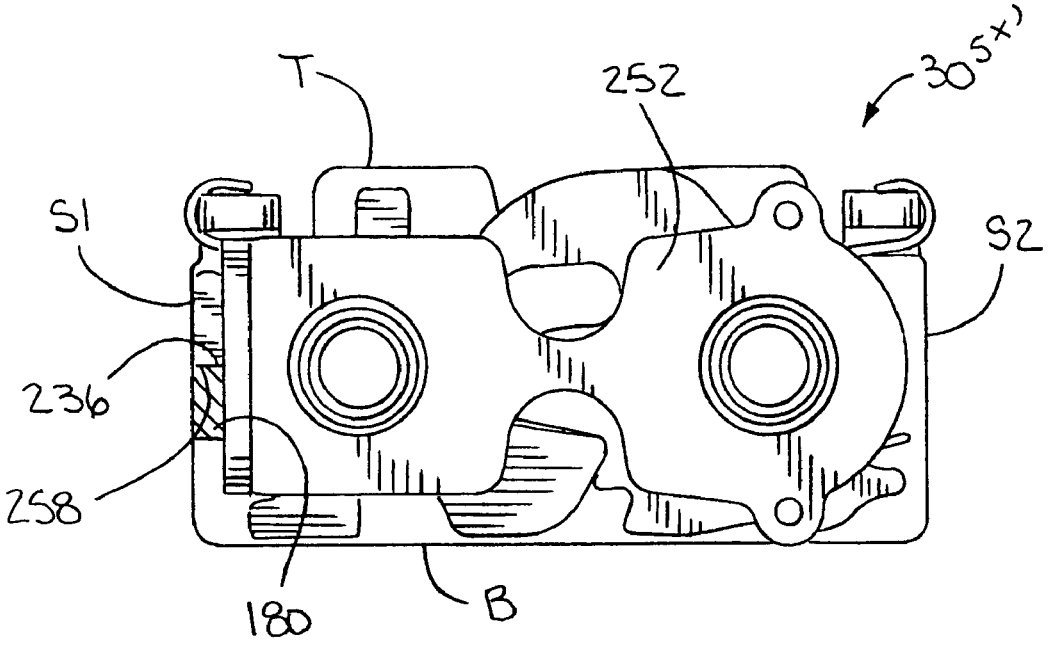
FIG. 29 is a front elevation view of the latch assembly in FIGS. 27 and 28.
Figure 30:
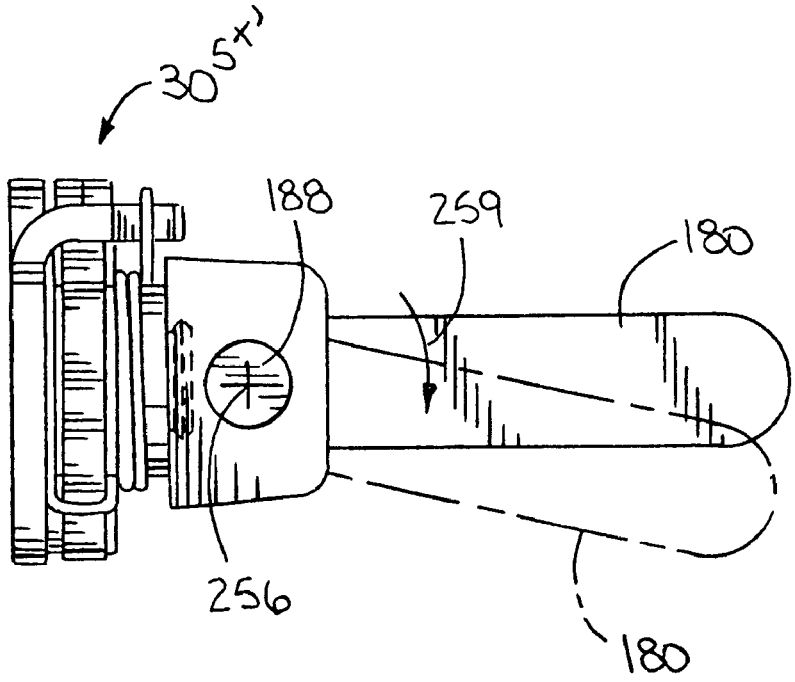
FIG. 30 is a side elevation view of the latch assembly in FIGS. 27-29.

With the trip component 180 moved between the normal/solid line and actuated/dotted line positions of FIG. 20, by pivoting movement thereof around an axis 246, defined by the mounting pin/rivet 188, in the direction of the arrow 248, the actuating edge 196 on the trip component 180 bears against an edge 250 on the catch arm 96, thereby causing the catch 20 to be moved from its engaged position into its disengaged position.

Thus, the latch assemblies 30", 30'" differ by reason of the locations of the mounting of the trip component 180.

In FIGS. 23-26, a latch assembly is shown at 30"" utilizing a fifth plate assembly 252 having a flat wall 146"" that has substantially the same general, rectangular shape as the flat wall 146" on the latch assembly 30". The difference between the fifth plate assembly 252 and the other plate assemblies described above resides in the location of a tab 254 for supporting the trip component 180. The tab 254 is vertically oriented, as opposed to the horizontal orientation for the tabs 154, 226, described above, and is located at the side S2 of the housing 174"".

The latch assembly 30"" uses the same configuration and arrangement of the first plate assembly 12, rotor 18, catch 20, axles 14, 16 and springs 106, 118, as the latch assembly 30. With the fifth plate assembly 252 operatively joined to the first plate assembly 12, and the trip component 180 operatively attached through the rivet 188 to the tab 254, the trip component 180 is pivotable about an axis 256 in the direction of the arrow 257 between the solid line/normal position and dotted line/actuated position of FIG. 26, to thereby move the catch 20 from the engaged position into the disengaged position. As this occurs, the actuating edge 196 on the trip component 180 bears upon an edge 258 on the catch arm 94 to effect the requisite movement of the catch 20.

In FIGS. 27-30, a further form of latch assembly is shown at $\mathbf{30}^{5x'}$. The latch assembly $\mathbf{30}^{5x'}$ utilizes the fifth plate assembly 252, which is rotated through 180° from the orientation for the latch assembly 30"". This reversal requires that the rotor 18 and catch 20 be axially reversed from the FIG. 23 orientation and interchanged with each other so that they are respectively journalled for rotation on the axles 16 and 14. The latch assemblies 30"", $\mathbf{30}^{5x'}$ use the exact same components—the first plate assembly 12, rotor 18, catch 20, axles 14, 16, coil springs 106, 118 and fifth plate assembly 252.

By reason of reversing the fifth plate assembly 252, the tab 254 is relocated to the side S1 of the housing $\mathbf{174}^{5x'}$. With the trip component 180 operatively mounted upon the tab 254 through the pin/rivet 188, the trip component 180 is pivoted about the axis 256 from the normal/solid line position of FIG. 30 into the actuated/dotted line position in that same Figure in the direction of the arrow 259 to cause repositioning of the catch 20. As this occurs, the actuating edge 236 on the trip component 180 bears upon the edge 258 on the catch arm 94 to effect the requisite movement of the catch 20 to change the same from its engaged position into its disengaged position.

Figure 31:
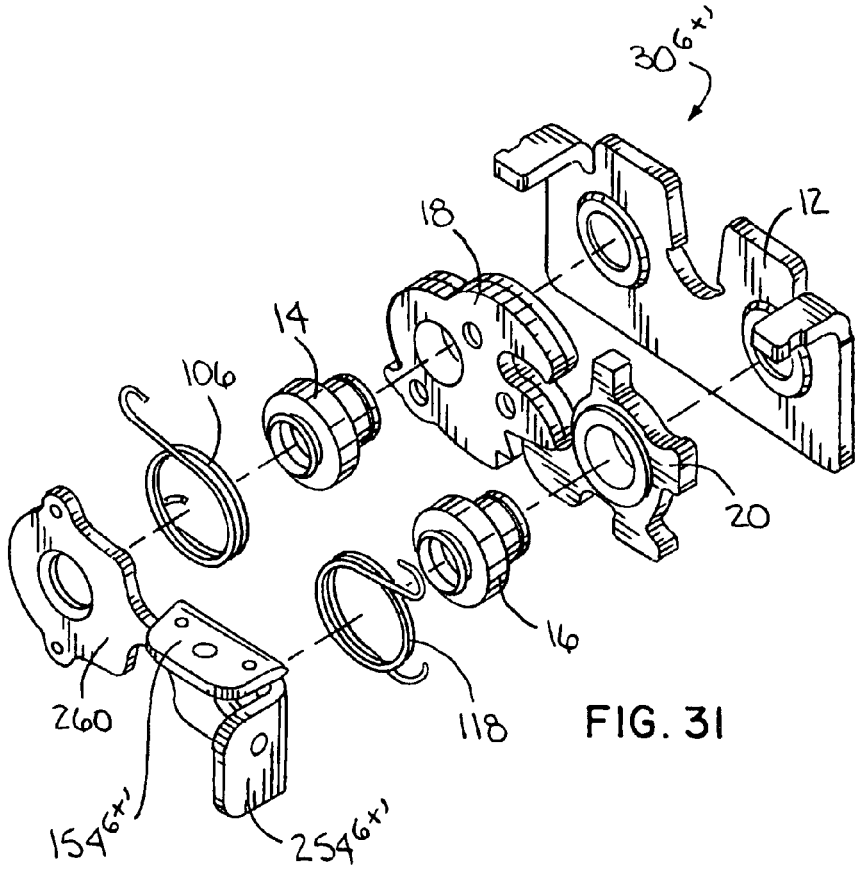
FIG. 31 is an exploded perspective view of a further modified form of latch assembly, according to the present invention.
Figure 32:
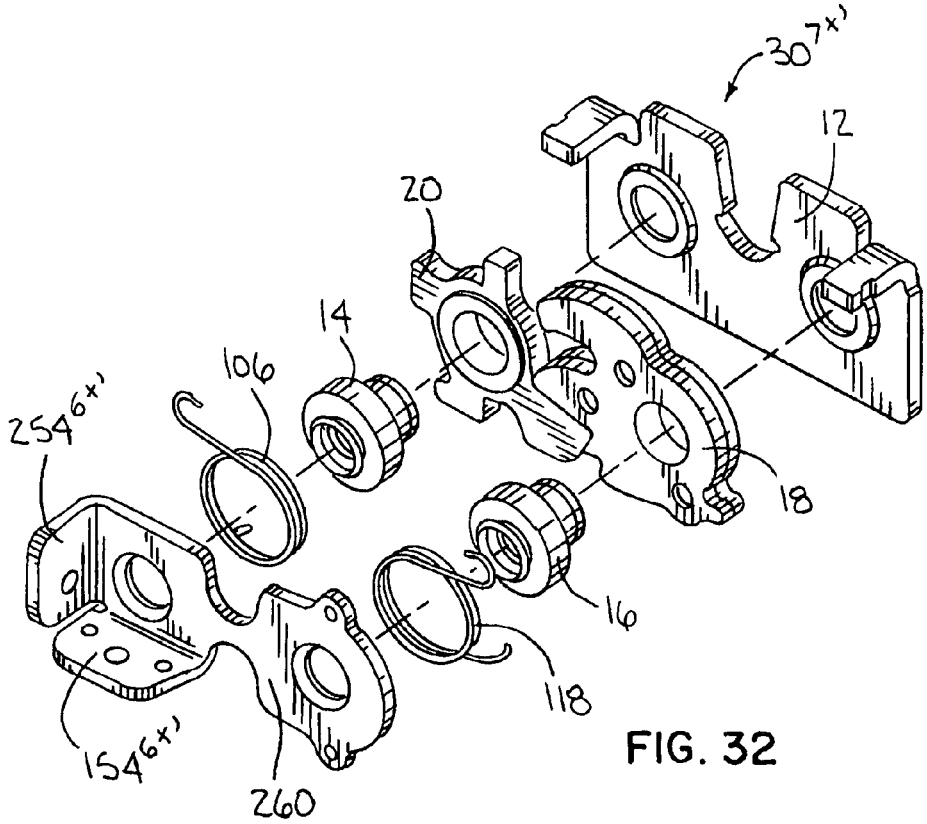
FIG. 32 is an exploded perspective view of a further modified form of latch assembly, according to the present invention.

In FIGS. 31 and 32, a sixth plate assembly is shown at 260 on latch assemblies $\mathbf{30}^{6x'}$, $\mathbf{30}^{7x'}$. The plate assembly 260 incorporates multiple tabs $\mathbf{154}^{6x'}$, $\mathbf{254}^{6x'}$, corresponding respectively to the tab 154 on the second plate assembly 26 and tab 254 on the fifth plate assembly 252. This configuration gives the manufacturer/end user the option of selecting different mounting locations for the trip component 180 that interacts with the catch 20 in the same manner that the trip component 180 interacts with the catch 20, when mounted on the tabs 154, 254, as previously described. A trip component 180 may be operatively mounted on only one of the tabs $\mathbf{154}^{6x'}$, $\mathbf{254}^{6x'}$ or on each of the tabs $\mathbf{154}^{6x'}$, $\mathbf{254}^{6x'}$, to both be available for use.

The sixth plate assembly 260 is operatively joined to the first plate assembly 12 in FIGS. 31 and 32 using the same rotor 18, catch 20, axles 14, 16 and springs 106, 118.

The sixth plate assembly 260 is reversed between the configurations of the latch assembly $\mathbf{30}^{6x'}$ in FIGS. 31 and $\mathbf{30}^{7x'}$ in FIG. 32. Reversal of the sixth plate assembly 260 also requires axial reversal of the rotor 18 and catch 20, and interchanging of the rotor 18 and catch 20 as in the prior embodiments.

In FIGS. 33 and 34, a seventh plate assembly 262 is shown on latch assemblies $\mathbf{30}^{8x'}$, $\mathbf{30}^{9x'}$ that, like the sixth plate assembly 260, incorporates multiple tabs $\mathbf{226}^{8x'}$, $\mathbf{254}^{8x'}$, corresponding to the tabs 226 and 254 respectively on the third plate assembly 26 and fifth plate assembly 252.

The latch assemblies $\mathbf{30}^{8x'}$ and $\mathbf{30}^{9x'}$ each incorporates the same components, including the first plate assembly 12, the rotor 18, the catch 20, the first and second axles 14, 16 and the coil springs 106, 118.

The tabs $\mathbf{226}^{8x'}$, $\mathbf{254}^{8x'}$ give the manufacturer/end user two location options at which the trip component 180 can be mounted. With the trip component 180 mounted on either of the tabs $\mathbf{226}^{8x'}$, $\mathbf{254}^{8x'}$, the cooperation with the catch 20 is the same as with the trip component 180 mounted on the tabs 226, 254, as earlier described.

In FIGS. 33 and 34, the seventh plate assembly 262 is reversed, which requires axial reversal of the rotor 18 and catch 20, as previously described.

In FIGS. 35 and 36, an eighth plate assembly 264 is shown incorporated into latch assemblies $\mathbf{30}^{10x'}$, $\mathbf{30}^{11x'}$, respectively. The eighth plate assembly 264 has tabs $\mathbf{186}^{10x'}$, $\mathbf{226}^{10x'}$, corresponding to the tab 186 on the latch assembly 30 and the tab 226 on the latch assembly 30". The tabs $\mathbf{186}^{10x'}$, $\mathbf{226}^{10x'}$ are designed to support the trip component 180 in the same manner as the tabs 186, 226 support the trip component 180 in the prior embodiments. The trip component 180 mounted on the tabs $\mathbf{186}^{10x'}$, $\mathbf{226}^{10x'}$ cooperates with the catch 20 on the latch assemblies $\mathbf{30}^{10x'}$, $\mathbf{30}^{11x'}$ in the same manner as it cooperates with the catch 20 when mounted upon the corresponding tabs 186 and 226, as previously described. As with all embodiments herein, the multiple tabs $\mathbf{186}^{10x'}$, $\mathbf{226}^{10x'}$ allow for simultaneous mounting of a like number of trip components 180, as shown in dotted lines in FIG. 35.

The eighth plate assembly 264 cooperates with the same components—the first plate assembly 12, the rotor 18, the catch 20, the first and second axles 14, 16 and the coil springs 106, 118, on each of the latch assemblies $\mathbf{30}^{10x'}$ and $\mathbf{30}^{11x'}$.

The eighth plate assembly 264 is operatively joined to the first plate assembly 12 on both latch assemblies $\mathbf{30}^{10x'}$ and $\mathbf{30}^{11x'}$ and is reversed in these two different latch assembly configurations. The reversal requires the corresponding axial reversal and interchanging of the rotor 18 and catch 20, as in the prior embodiments.

Figure 37:
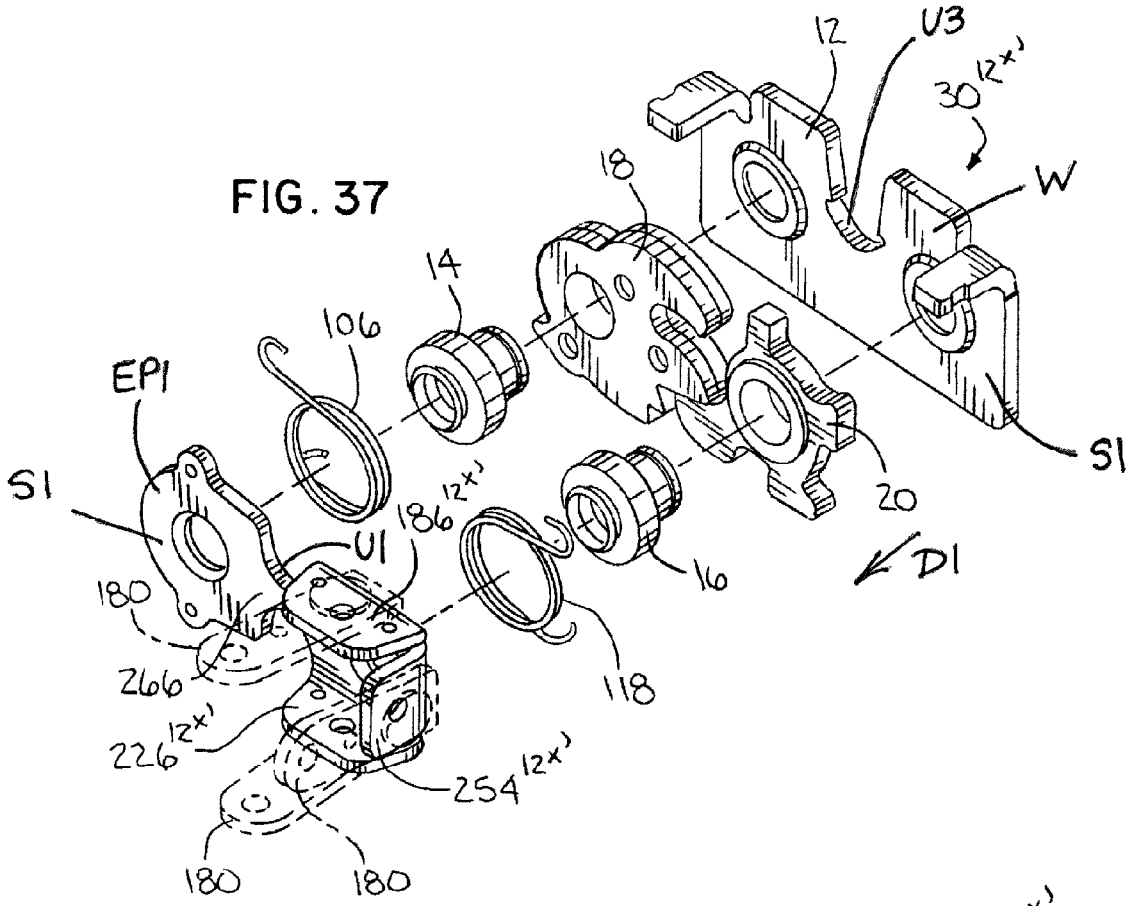
FIG. 37 is an exploded perspective view of a further modified form of latch assembly, according to the present invention.
Figure 38:
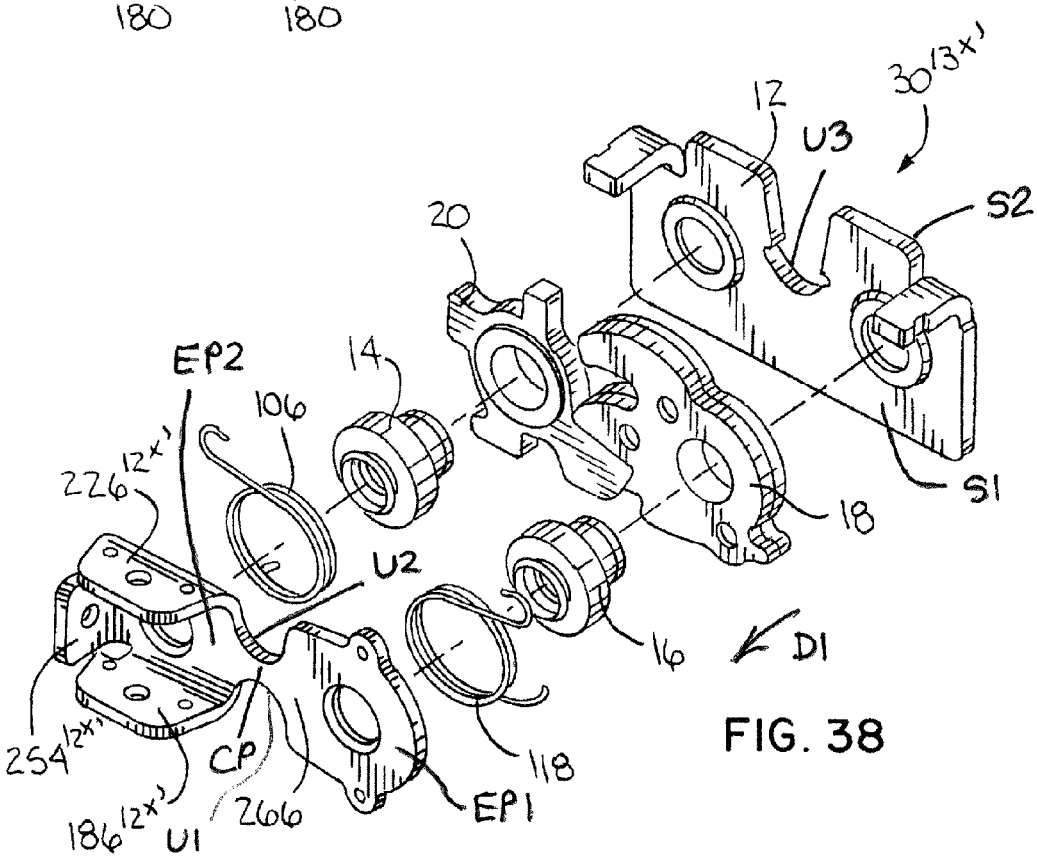
FIG. 38 is an exploded perspective view of a further modified form of latch assembly, according to the present invention.
Figure 39:
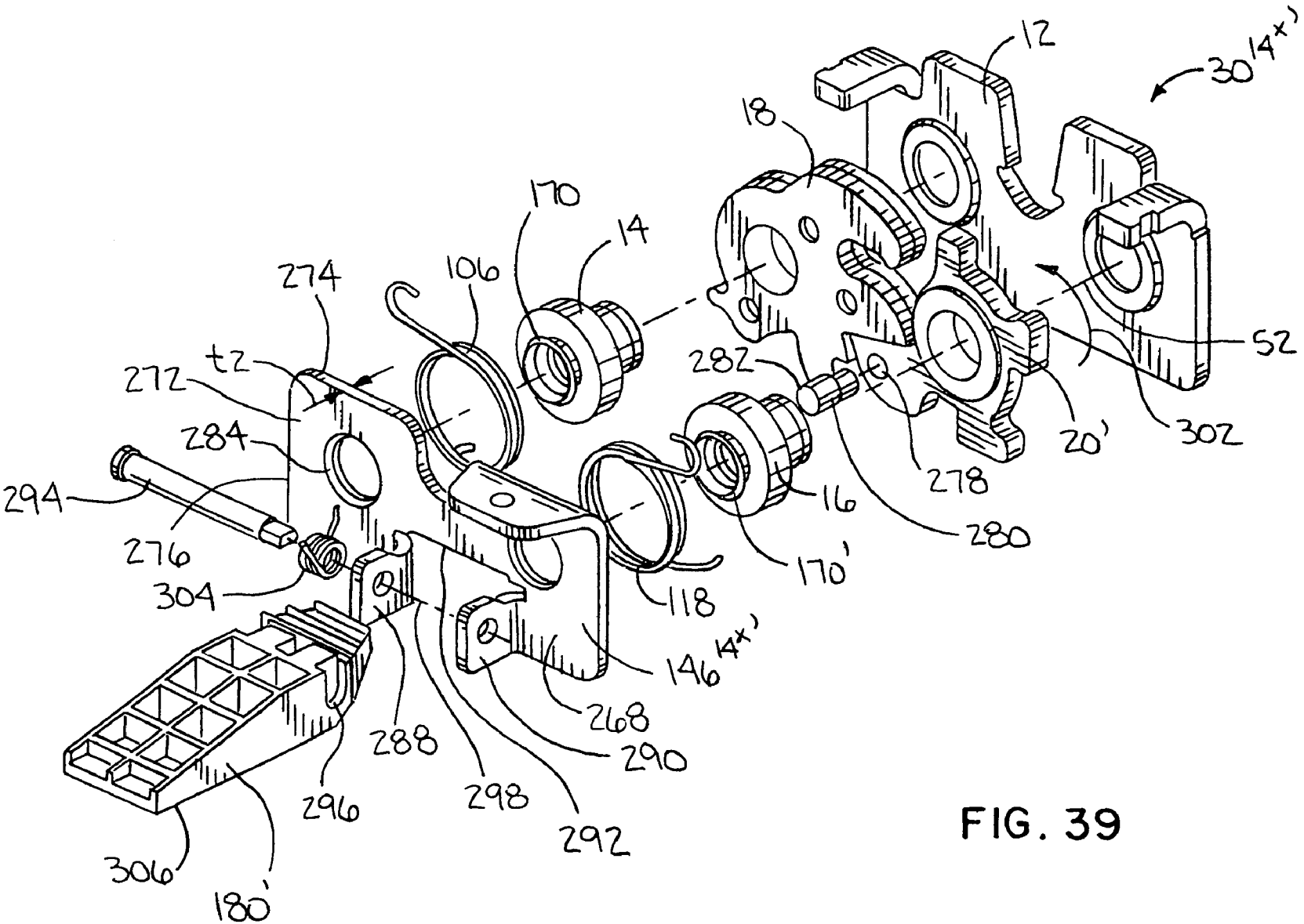
FIG. 39 is an exploded perspective view of a further modified form of latch assembly, according to the present invention.

In FIGS. 37 and 38, latch assemblies, shown at $\mathbf{30}^{12x'}$ and $\mathbf{30}^{13x'}$, respectively incorporate a ninth latch assembly 266. The ninth plate assembly 266 has three tabs, with the tabs $\mathbf{186}^{12x'}$, $\mathbf{226}^{12x'}$, corresponding to the tab 186 on the latch assembly 30 and tab 226 on the latch assembly 30". The third tab $\mathbf{254}^{12x'}$, corresponds to the tab 254 on the latch assembly 30"".

The three tabs $\mathbf{186}^{12x'}$, $\mathbf{254}^{12x'}$ and $\mathbf{226}^{12x'}$ give the manufacturer/end user the option of mounting the trip component 180 at any, or all, of three locations at which the tabs reside, as shown in dotted lines in FIG. 37. With the trip component 180 mounted on the tabs $\mathbf{186}^{12x'}$, $\mathbf{254}^{12x'}$ and $\mathbf{226}^{12x'}$, the trip component 180 is movable between normal and actuated positions to cooperate with the catch 20 in the same manner as it cooperates with the catch 20 when mounted upon the tabs 186, 226, 254, as hereinbefore described.

The ninth plate assembly 266 cooperates with the same components on the latch assemblies $\mathbf{30}^{12x'}$ and $\mathbf{30}^{13x'}$, as previously described, to include the first plate assembly 12, the rotor 18, the catch 20, the first and second axles 14, 16 and the springs 106, 118.

The configuration of the latch assemblies $\mathbf{30}^{12x'}$ and $\mathbf{30}^{13x'}$ differs by reason of the rotation/reversal of the ninth plate assembly 266 in these two structures. This requires reversal and interchanging of the rotor 18 and catch 20, as previously described for other embodiments above.

While all of the embodiments are described above as they cooperate with the trip component 180, the use of the trip component 180 is only exemplary in nature. Other means of operating the latch assemblies are contemplated, with exemplary ones described hereinbelow.

The embodiment in FIGS. 37 and 38 is representative of many of the embodiments herein with a wall W on the first plate assembly 12 from which the axles 14, 16 project in a first direction, as indicated by the arrow D1. The plate assembly 266 has oppositely facing first and second surfaces S1,S2, with the first surface S1 facing in the first direction indicated by the arrow D1. The first surface S1 remains facing in the first direction with the plate assembly 266 joined to the first plate assembly 12 in each of the two different operative relationships in FIGS. 37 and 38.

The plate assembly 266 is representative of other embodiments in terms of its overall shape. That is, the plate assembly has end portions EP1. EP2 that are joined through a connecting portion CP, that has a locally reduced area as viewed in an axial direction, relative to the axles 14, 16, so that from this perspective the plate assembly has the appearance of the number "8", with oppositely opening, U-shaped receptacles U1, U2. The receptacles U1, U2 register, one each, with a U-shaped receptacle U3 on the first plate assembly 12, to accept a strike element in operation, with the plate assembly 266 in the two depicted operative relationships.

In FIGS. 39-42, a tenth plate assembly is shown at 268 on a latch assembly $\mathbf{30}^{14x'}$ and is designed to accommodate a different type of trip component, in the form of a push actuated lever 180'. The eleventh plate assembly 268 has a rectangular flat wall $\mathbf{146}^{14x'}$ that does not require the "hourglass" shape that permits vertical reversal thereof with respect to the first plate assembly 12, but is generally rectangular in shape, as are all other plate assemblies disclosed herein.

The flat wall $\mathbf{146}^{14x'}$ on the tenth plate assembly 268 has oppositely facing flat surfaces 272, 274 that are substantially parallel to each other and a reference plane RP2. The flat wall $\mathbf{146}^{14x'}$ has a uniform thickness t2 between the flat surfaces 272, 274. The peripheral edge 276 of the flat wall $\mathbf{146}^{14x'}$ has the uniform thickness t2 over substantially the entirety of the extent thereof, with the thickness t2 residing in a space between two planes at the flat surfaces 272, 274.

The latch assembly $\mathbf{30}^{14x'}$ incorporates the rotor 18, a slightly modified form of catch 20', the axles 14, 16 and the coil assemblies 106, 118.

The catch 20' differs from the catch 20 by reason of providing a through or blind bore 278 which receives a post 280 with an enlarged head 282 thereon. The first plate assembly 12, rotor 18, catch 20', axles 14, 16 and springs 106, 118 are assembled the same as are the corresponding components in all other embodiments described herein.

The plate assembly 268 has bores 284, 286 that respectively receive the axle ends 170, 170', at which the flat wall $\mathbf{146}^{14x'}$ is secured.

The tenth plate assembly 268 has tabs 288, 290 projecting transversely, and preferably orthogonally, to the reference plane RP2. The tabs 288, 290 may be struck directly from the material defining the flat wall $\mathbf{146}^{14x'}$ and are bent to the shape shown whereby an opening 292 is provided through the flat wall $\mathbf{270}^{14x'}$. The opening 292 permits interaction between the trip component 180' and the head 282 on the post 280.

A headed pin 294 extends through the tabs 288, 290 and a bore 296 through the trip component 180', with the trip component 180' operatively situated between the tabs 288, 290. The trip component 180' is pivotable about an axis 298 defined by the pin 294 between a normal position, as shown in solid lines in FIG. 42, and an actuated position, as shown in dotted lines in that same Figure. As the trip component 180' is pivoted from its normal position into its actuated position, a surface/edge 300 bears against the head 282 of the post 280, thereby driving the catch 20' in the direction of the arrow 302 around the axis 52 to allow the rotor 18 to be changed from its latched position into its released position.

The trip component 180' is normally biased by a coil spring 304 into its normal/solid line position of FIG. 42. The trip component 180' has an actuating surface 306 that can be directly pressed upon by a user to effect repositioning thereof.

To add versatility to the tenth plate assembly 268, an optional tab $\mathbf{186}^{14x'}$ is provided at a location corresponding to that for the tab 186 on the latch 30. The tab $\mathbf{186}^{14x'}$ supports the trip component 180 in a manner that it can be pivoted to cooperate with the catch 20' in the same manner as it cooperates with the catch 20 on the latch assembly 30.

As a still further alternative, an additional tab $\mathbf{226}^{14x'}$, as shown in dotted lines in FIG. 40, might be included instead of, or in addition to, the tab $\mathbf{186}^{14x'}$. The tab $\mathbf{226}^{14x'}$ is capable of supporting the trip component 180 for operation and interaction with the catch 20' in the same manner as it would cooperate with the catch 20 on the tab 226 on the latch 30".

Figure 43:
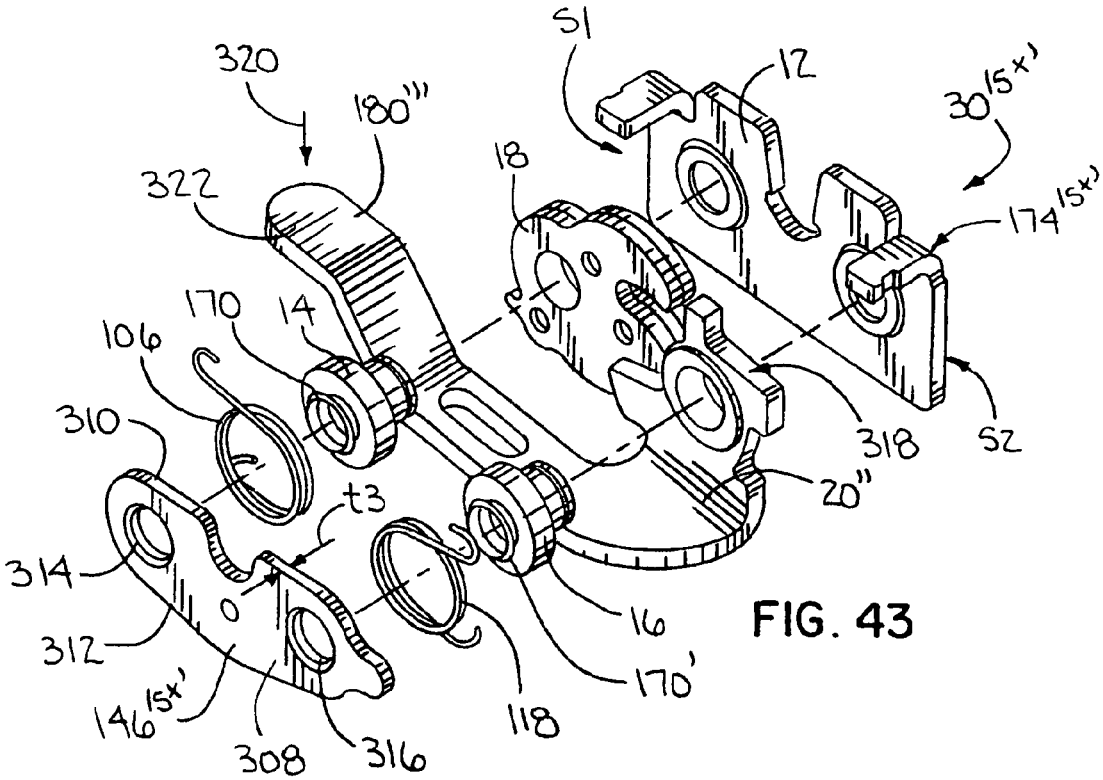
FIG. 43 is an exploded perspective view of a further modified form of latch assembly, according to the present invention.

A further form of latch assembly is shown in FIG. 43 at $\mathbf{30}^{15x'}$. The latch assembly $\mathbf{30}^{15x'}$ incorporates the first plate assembly 12, the rotor 18, the axles 14, 16 and the springs 106, 118. The latch assembly $\mathbf{34}^{15x'}$ further incorporates an eleventh plate assembly 308. The eleventh plate assembly 308 has a wall $\mathbf{146}^{15x'}$ that is flat with a generally rectangular shape and a uniform thickness t3 between oppositely facing flat surfaces 310, 312. The plate assembly 308 has spaced bores 314, 316 to receive the axle ends 170, 170'.

The latch assembly $\mathbf{30}^{15x'}$ incorporates a catch 20" that has an integrally formed trip component 180" that moves as one piece therewith. The trip component 180" is defined as an extension of the flat catch component portion 318 that interacts with the rotor 18. By applying a force in the direction of the arrow 320 upon the surface 322 of the trip component 180" at the side S1 of the housing $\mathbf{174}^{15x'}$, the catch 20" is changed from an engaged position into a disengaged position correspondingly as the rotor 20 is in the other embodiments, described above.

Figure 44:
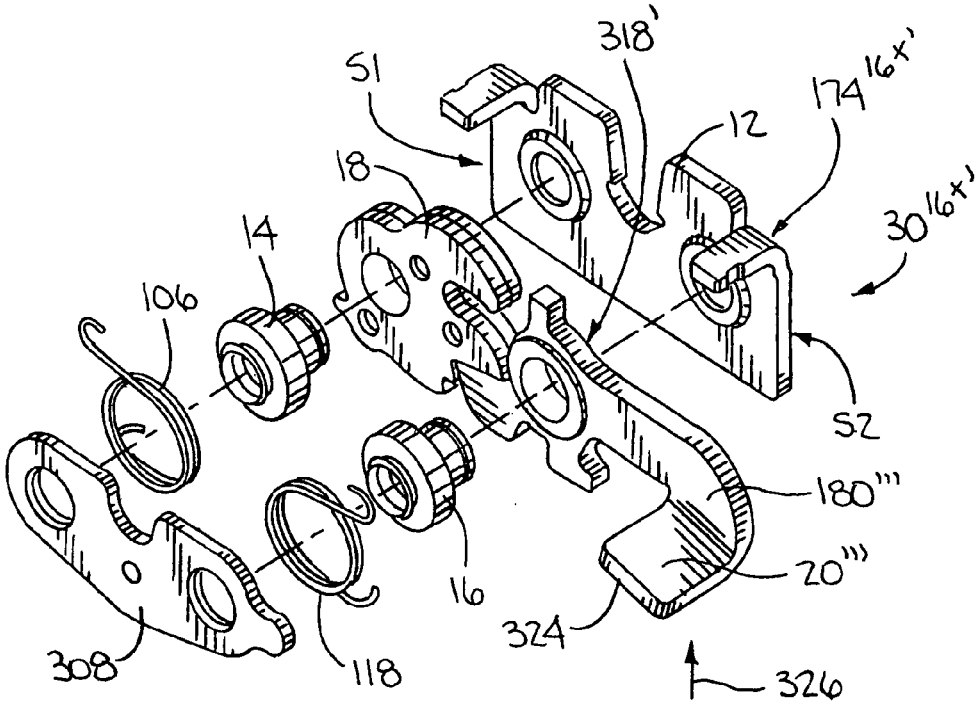
FIG. 44 is an exploded perspective view of a further modified form of latch assembly, according to the present invention.

The actuating location and direction of force application required to reposition the catch can be changed from that for the latch assembly $\mathbf{30}^{15x'}$ in FIG. 43 by providing a further modified form of catch 20'", as shown on the latch assembly $\mathbf{30}^{16x'}$ in FIG. 44. The latch assembly $\mathbf{30}^{16x'}$ incorporates the same first plate assembly 12, rotor 18, springs 106, 118 and plate assembly 308 as the latch assembly $\mathbf{30}^{15x'}$ in FIG. 43. In this embodiment, the corresponding catch portion 318' has an integrally formed trip component 180'" that is configured so that an operating force must be applied to a surface 324 generally in the direction of the arrow 326 at the side S2 of the housing $\mathbf{174}^{16x'}$ to pivot the catch 20'" from an engaged position into a disengaged position.

With the above-described structures, many variations from what is specifically shown can be devised to meet different demands and for different applications.

Figure 45:
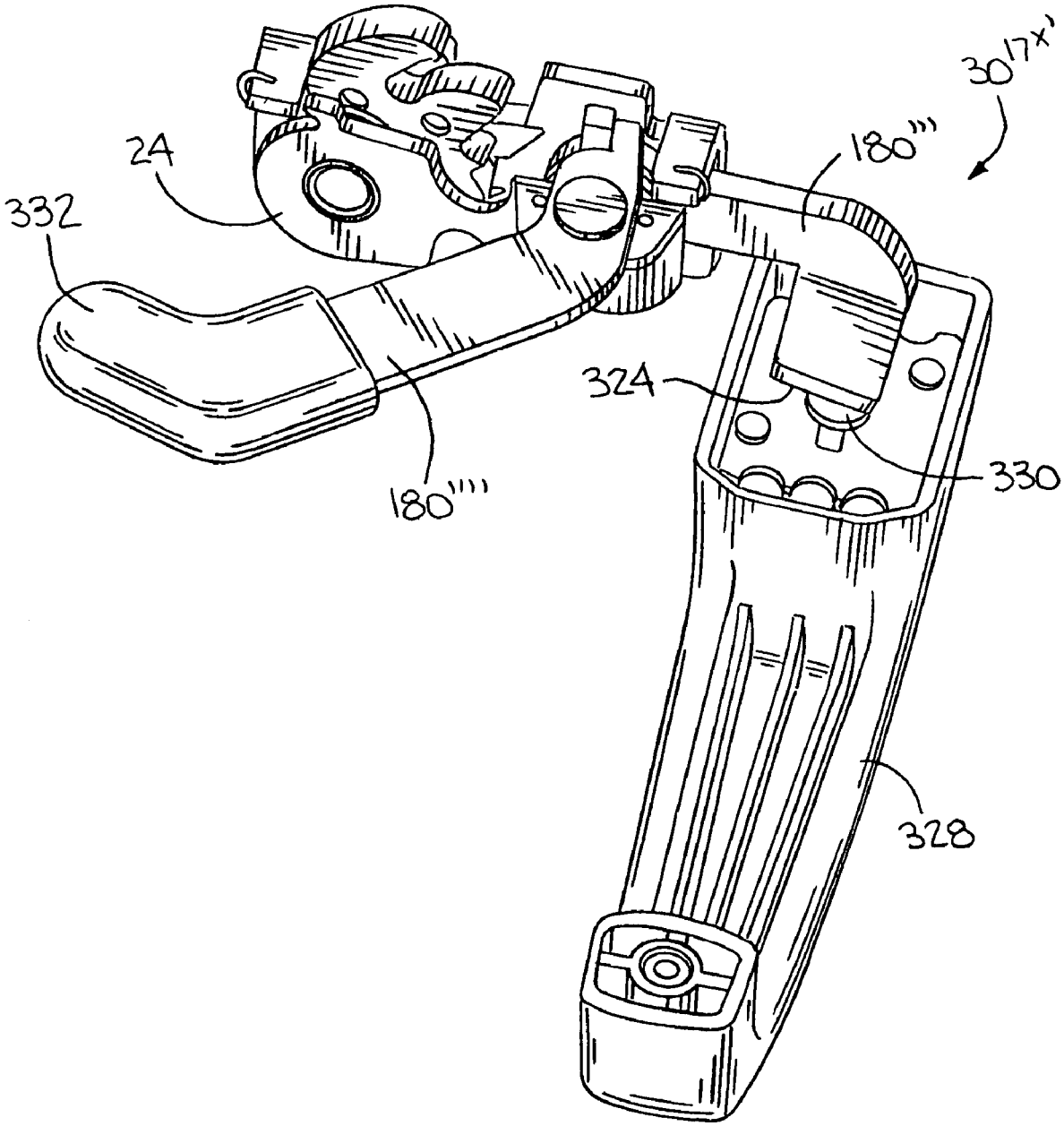
FIG. 45 is a perspective view of one form of the inventive latch assembly and an actuator assembly associated therewith, including a push button actuator element.

For example, as shown in FIG. 45, a latch assembly is shown at $\mathbf{30}^{17x'}$, incorporating the second plate assembly 24 from the latch assembly 30 and the trip component 180'" from the latch assembly $\mathbf{30}^{16x'}$. An actuator assembly includes a handle 328 with a push button mechanism 330 that is used to apply an operating force upon the surface 324 on the trip component 180'".

Instead of incorporating the trip component 180, a trip component 180"" is provided which has general "U" shape with a padded end grip 332. This configuration is typically used for skidsteer or on small construction equipment.

Figure 46:
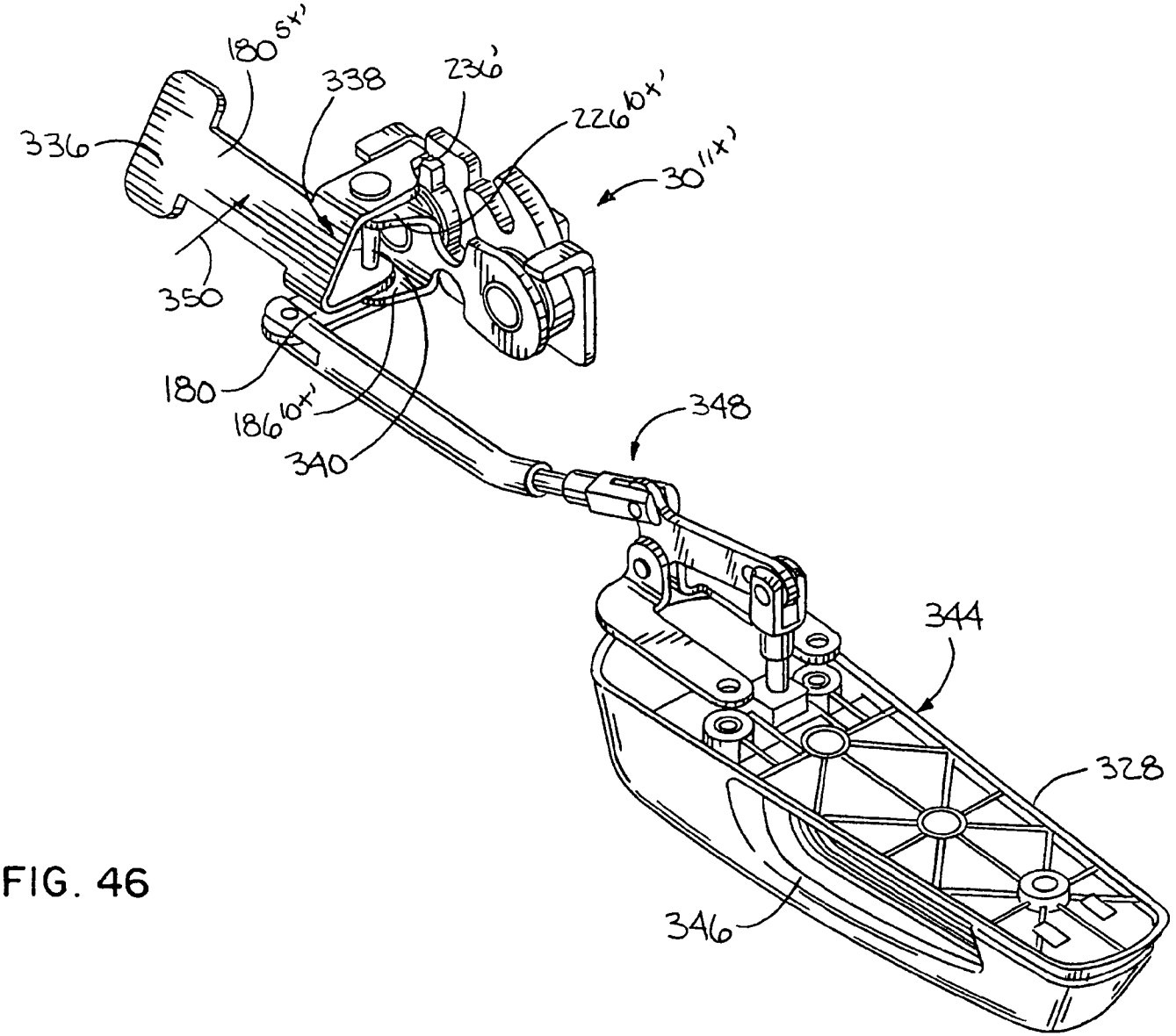
FIG. 46 is a perspective view of one form of the inventive latch assembly with a modified form of actuator assembly, according to the present invention, including a push-type trip component and a pull handle actuator element.

In FIG. 46, the latch assembly $\mathbf{30}^{11x'}$ is used and has a trip component $\mathbf{180}^{5x'}$ in the form of a pull handle that substitutes for the trip component 180 in earlier described embodiments. The trip component $\mathbf{180}^{5x'}$ has a graspable end 336 that terminates at a U-shaped portion 338 that connects to both tabs $\mathbf{226}^{10x'}$, $\mathbf{186}^{10x'}$ through a pin 340. The trip component $\mathbf{180}^{5x'}$ has an actuating edge 236', corresponding to the actuating edge 236 on the trip component 180, and performs the same function as the graspable end 336 is pushed in the direction of the arrow 350.

The pin 140 also supports a trip component 180 on the tab $\mathbf{186}^{10x'}$ for cooperation with the catch 20, as previously described.

The trip component 180 is operable through an actuator assembly, including a pull handle assembly 344. A handle 346 is graspable and pivotable as described in U.S. Pat. No. 7,097,216, which is incorporated herein by reference. By pivoting the handle 346, a linkage 348 is operated to reposition the trip component 180 to thereby change the catch 20 from its engaged position into its disengaged position.

As shown in FIGS. 47 and 48, a modified form of trip connector $\mathbf{180}^{6x'}$, in combination with a trip component 180, is shown and is configured to reverse the actuating direction for the trip component $\mathbf{180}^{6x'}$ from that of the trip component $\mathbf{180}^{5x'}$ in FIG. 46 using the same basic latch assembly $\mathbf{30}^{11x'}$. Also changed is the location at which an actuating force must be applied to operate the latch assembly $\mathbf{30}^{11x'}$. That is, in FIG. 46, the force application is in the direction of the arrow 350, whereas in FIGS. 47 and 48, the force application is oppositely thereto in the direction of the arrow 352 and on opposite sides of the housing 174.

Figure 49:
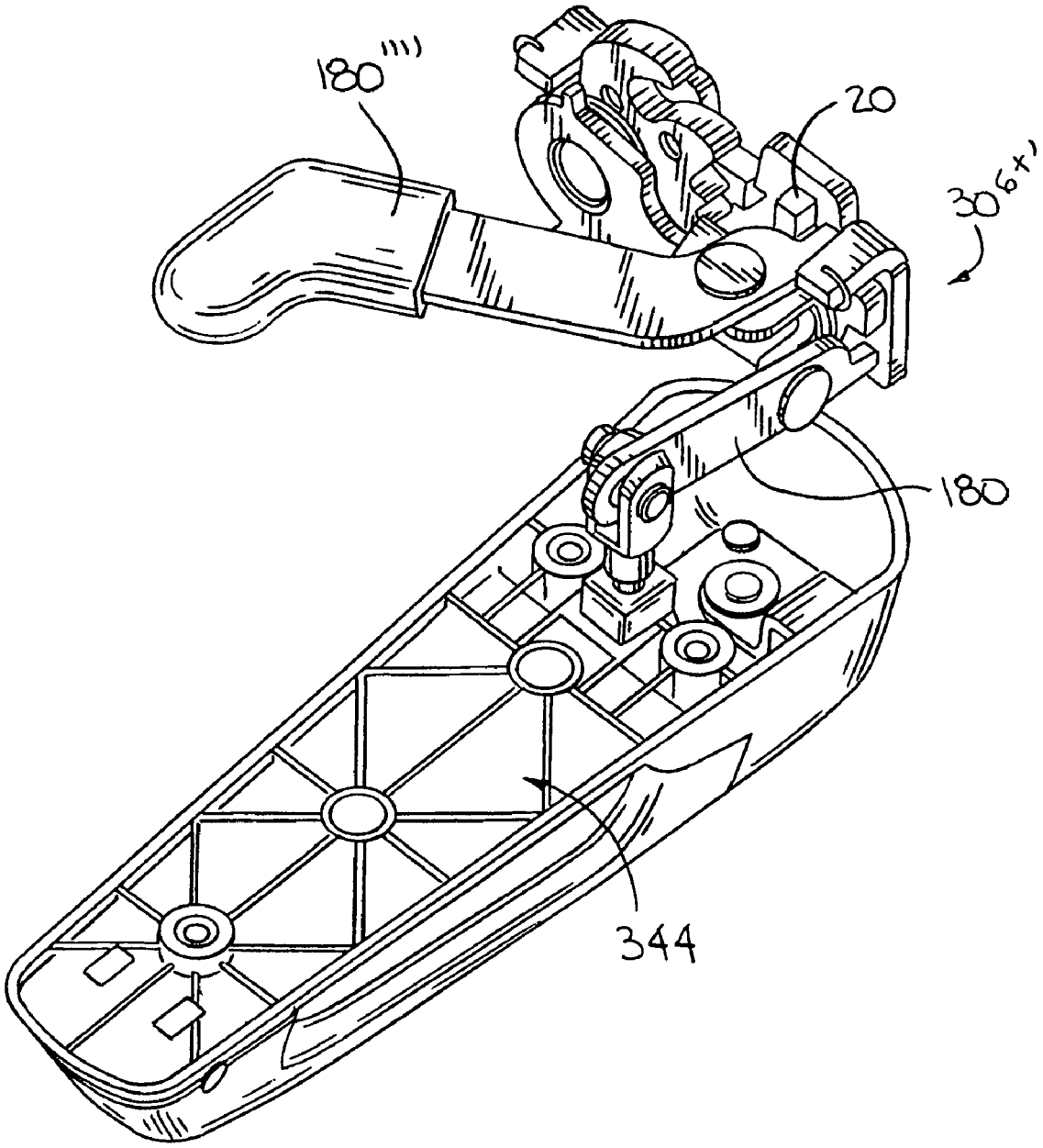
FIG. 49 is a perspective view of one form of the inventive latch assembly with an actuator including a pull handle actuator element and a pivotable trip component.

In another variation, as shown in FIG. 49, a latch assembly $\mathbf{30}^{6x'}$ has the trip component 180 thereon connected to the pull handle assembly 344 of FIG. 46. The trip component 180'" is also incorporated to allow the catch 20 to be repositioned by different mechanisms at different locations.

Figure 50:
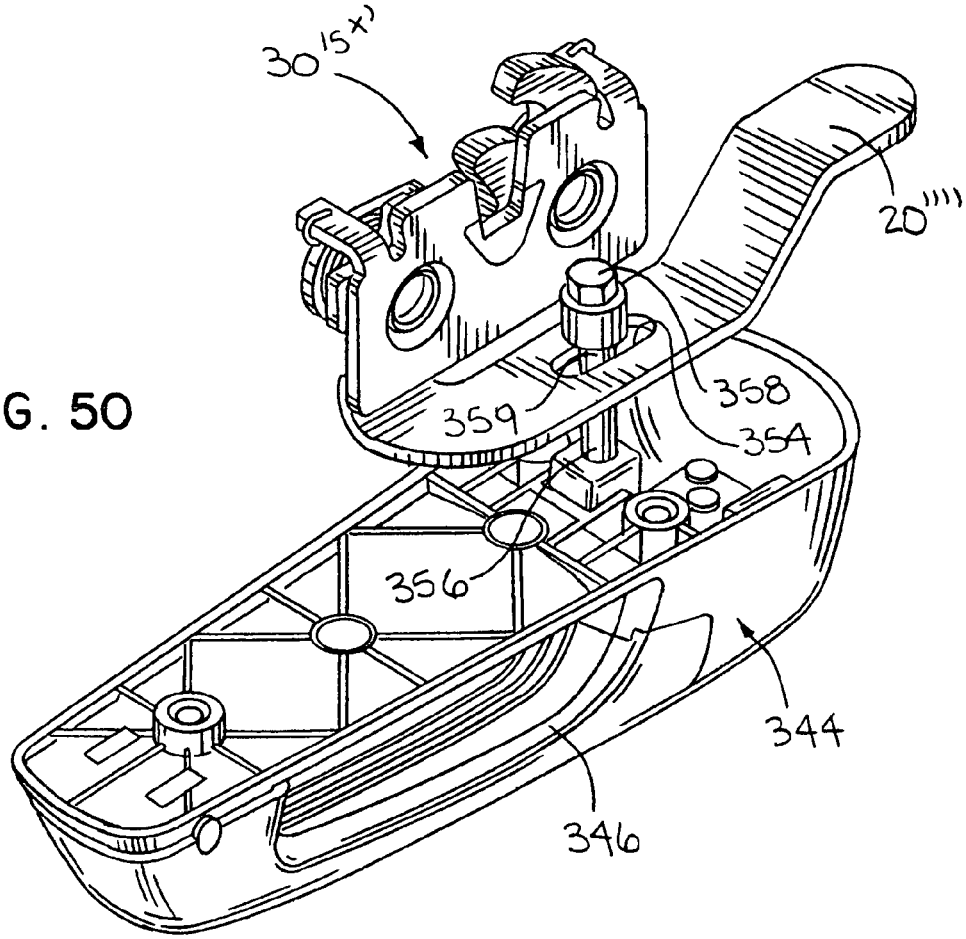
FIG. 50 is a perspective view of one form of the inventive latch assembly with an actuator assembly in the form of a pull handle actuator element.

In FIG. 50, the pull handle assembly 344 is operatively connected to a catch 20"" similar to the catch 20'", but reversed in terms of the inside/outside location at which it is operated from. The catch 20"" is integrated with the other components on the latch assembly $\mathbf{30}^{15x'}$. The catch 20"" has an elongate bore 354 to receive a translatable shaft 356 the moves with the handle 346. An enlargement 358 on the shaft end 359 draws the catch 20"" so that it follows movement of the handle 346.

Figure 51:
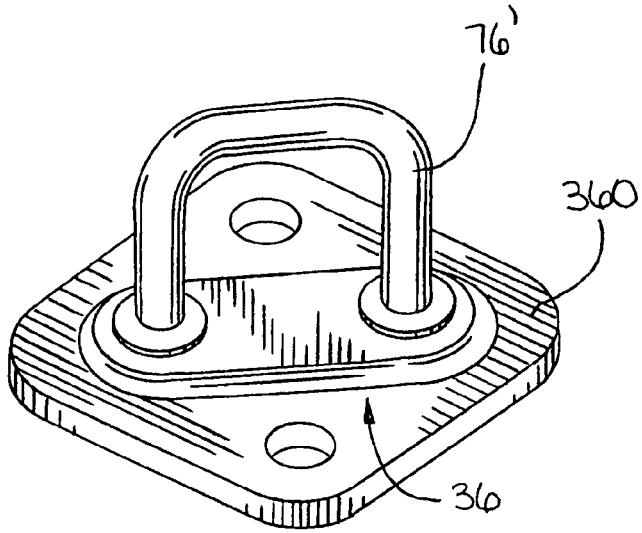
FIG. 51 is a perspective view of one form of strike assembly, useable with the inventive latch assemblies, with a strike element in the form of a closed hoop.

In FIG. 51, one preferred form of strike assembly 36 is depicted having a mounting plate 360 with a strike element 76' in the form of a closed hoop component that cooperates with the rotor 18. The closed hoop arrangement is preferred in that it does not present sharp surfaces or free ends that may hang up on clothing or other objects.

Figure 52:
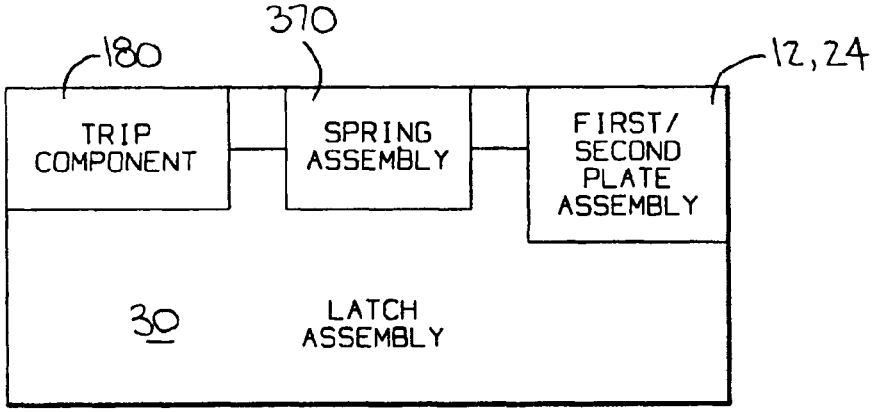
FIG. 52 is a schematic representation of a spring assembly on the latch assembly in FIGS. 6-10 that resiliently maintains the trip component in a predetermined position.

For exemplary latch assembly 30, as shown in FIGS. 6-10, the trip component 180 is normally resiliently biased by a spring assembly 370, as shown in FIG. 52. The spring assembly 370 acts between the trip component body 182 and the second plate assembly 24, and potentially the first plate assembly 12. The spring assembly 370 is useable in the same fashion with all latch assembly variations described herein but will be described in detail for only the exemplary latch assembly 30, with respect to FIGS. 53 and 54.

Figure 53:
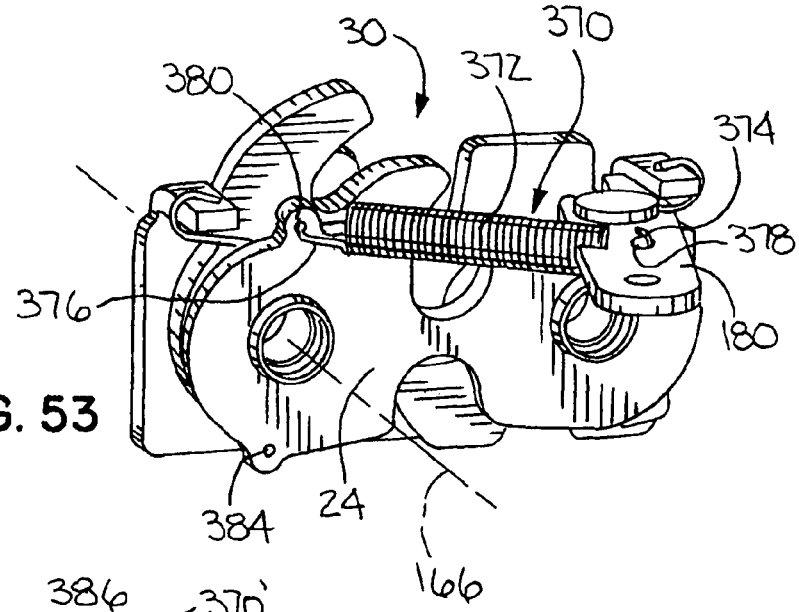
FIG. 53 is a perspective view of the latch assembly in FIGS. 6-10 with one form of spring assembly incorporated.

As seen in FIGS. 6 and 53, one form of the spring assembly 370 consists of an extension spring 372 having U-shaped ends 374, 376, directed respectively through openings 378, 380 in the trip component 180 and the second plate assembly 24. The spring 372 is pre-loaded in tension, or loaded in tension by movement of the trip component 180 from its normal position into its actuated position, whereby the trip component 180 in its actuated position is resiliently biased by the spring 372 back towards its normal position.

The second plate assembly 24 has an additional through opening 384 to accommodate a spring end with the second plate assembly 24 in a different orientation with respect to the first plate assembly 12 and/or with a different trip component configuration. The through opening 384 is diametrically opposite to the through opening 380 with respect to the axis is 166.

Figure 54:
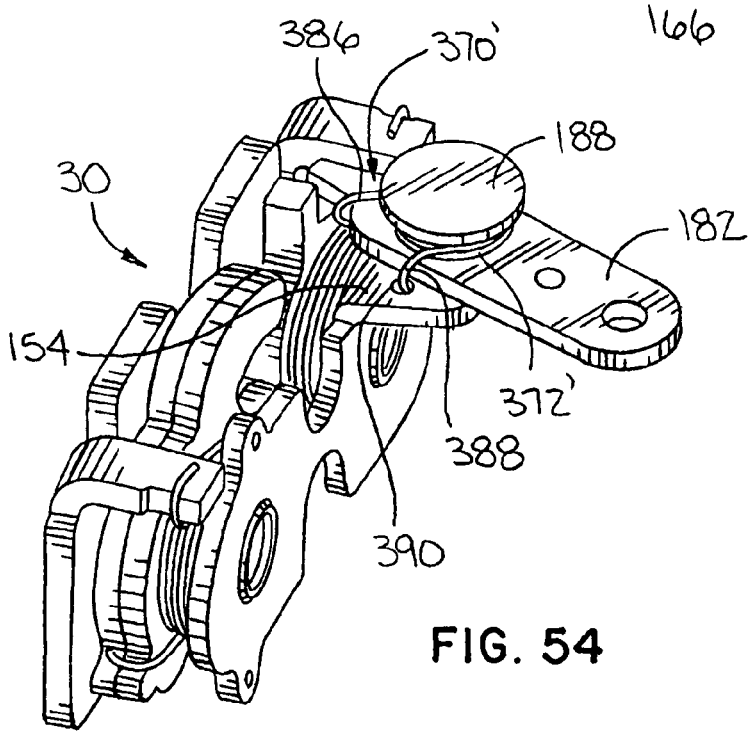
FIG. 54 is a view as in FIG. 53 with another form of spring assembly.

As seen in FIGS. 6 and 54, a modified form of the spring assembly 370' on the exemplary rotor 30 utilizes a tension coil spring 372', that is coiled around the rivet 188 and has opposite ends 386, 388 that respectively engage the trip component body 182 and extend through an opening 390 in the tab 154. The coil spring 372' is pre-loaded, or loaded by movement of the trip component 180 from its normal position into its actuated position, to have a residual force, with the trip component 180 in its actuated position, that resiliently urges the trip component 180 back into its normal position.

The tab 154 has a separate tab opening 392 to accept a spring end with the second plate assembly 24 in a different orientation with respect to the first plate assembly 12 and/or with a different trip component configuration.

By pre-engineering non-handed and common components, the number and complexity of components required to be manufactured, inventoried, and staged for assembly can be reduced compared to customized latch assembly designs that do not share common components. This also saves the project engineering and application support, prototyping, testing and tooling lead time, which potentially shortens time to market.

By providing latch assembly constructions that allow for multiple actuation locations, smaller, simpler, and lower cost designs are made possible compared to conventional designs.

The foregoing disclosure of specific embodiments is intended to be illustrative of the broad concepts comprehended by the invention.

The invention claimed is:

1. A latch assembly combination comprising:

a) a first plate assembly with inner and outer surfaces;

b) first and second axles mounted to and extending in a first direction from the first plate assembly inner surface and respectively having first and second axes;

c) a rotor movable between latched and released positions, d) a catch movable between: i) an engaged position wherein the catch blocks the rotor in the latched position; and ii) a disengaged position wherein the rotor is allowed to change from the latched position into the released, the rotor and catch selectively mountable to a respective axle in: a) a first axle configuration wherein the rotor is mounted to the first axle and the catch is mounted to the second axle; and b) a second axle configuration wherein the rotor is mounted to the second axle and the catch is mounted to the first axle;

e) a biasing assembly for normally urging the rotor toward the released position and the catch toward the engaged position; and f) at least second and third plate assemblies that can be selectively operatively joined, one in place of the other, to the first plate assembly, each of the at least second and third plate assemblies comprising: a) inner and outer surfaces; b) spaced first and second ends; and c) at least one tab adjacent a respective one of the ends and extending in a first direction from a respective outer surface, wherein with the rotor and catch in each of the first and second axle configurations, the operatively joined one of the at least second and third plate assemblies has one of its respective ends adjacent to the catch and its respective at least one tab extending in the first direction so as to allow the latch assembly to be selectively positioned in different latch configurations; and g) an actuating system operatively connected to the one tab on the operatively joined one of the at least first and second plate assemblies to move the catch from the engaged position toward the disengaged position to thereby release the rotor.

2. The latch assembly combination according to claim 1 wherein the actuating system comprises a first trip assembly with a first trip component that is mounted to the operatively joined second plate assembly for guided movement between: a) a normal position; and b) an actuated position, movement of the first trip component from the normal position into the actuated position causing the catch to be moved from the engaged position into the disengaged position.

3. The latch assembly combination according to claim 2 wherein the actuating system further comprises a first actuator assembly that is operable to cause the first trip component to be moved from the normal position into the actuated position.

4. The latch assembly combination according to claim 2 wherein the second plate assembly has first and second bores with first and second axes, the second plate assembly can be operatively joined to the first plate assembly in a first manner wherein the first and second axes of the axles are respectively aligned with the first and second axes of the bores, and the second plate assembly can be operatively joined to the first plate assembly in a second manner wherein the first and second axes of the axles are respectively aligned with the second and first axes of the bores.

5. The latch assembly combination according to claim 4 wherein with the second plate assembly operatively joined to the first plate assembly in the first manner, the rotor is mounted to the first axle and the catch is mounted to the second axle and with the second plate assembly operatively joined to the first plate assembly in the second manner, the rotor is mounted to the second axle and the catch is mounted to the first axle.

6. The latch assembly combination according to claim 5 wherein the trip component is mounted to the second plate assembly in the same manner with the second plate assembly operatively joined to the first plate assembly in each of the first and second different manners.

7. The latch assembly combination according to claim 1 wherein the biasing assembly comprises a first coil spring that cooperates between at least one of the first and second plate assemblies and the rotor with the second plate assembly operatively joined to the first plate assembly with the latch assembly in one configuration to bias the rotor toward the released position, the same first coil spring cooperating between the at least one of the first and second plate assemblies and catch with the second plate assembly operatively joined to the first plate assembly with the latch assembly in a second configuration to bias the catch towards the engaged position.

8. The latch assembly combination according to claim 5 wherein the rotor has a receptacle for a strike element, the second plate assembly has first and second oppositely opening U-shaped receptacles, with the second plate assembly operatively joined to the first plate assembly in the first manner the rotor receptacle aligns with the first U-shaped receptacle, and with the second plate assembly operatively joined to the first plate assembly in the second manner, the rotor receptacle aligns with the second U-shaped receptacle.

9. The latch assembly combination according to claim 1 wherein the first plate assembly, first and second axles and rotor are substantially the same with each of the at least second and third plate assemblies operatively joined to the first plate assembly.

10. The latch assembly combination according to claim 9 wherein the biasing assembly comprises at least one coil spring that is substantially the same with each of the at least second and third plate assemblies operatively joined to the first plate assembly.

11. The latch assembly combination according to claim 10 wherein the first plate assembly comprises a flat wall with the inner and outer surfaces that are oppositely facing flat surfaces that are substantially parallel to each other and a first reference plane, the oppositely facing flat surfaces bound a first thickness, and the first plate assembly further comprises first and second discrete tabs that project transversely to the first reference plane and define a support for the at least one coil spring.

12. The latch assembly combination according to claim 11 wherein the at least one coil spring comprises at least first and second coil springs, the first coil spring acting between the rotor and first discrete tab to urge the rotor towards the released position, the second coil spring acting between the catch and second discrete tab to urge the catch towards the engaged position.

13. The latch assembly combination according to claim 11 wherein the flat wall and first and second discrete tabs are formed as one piece.

14. The latch assembly combination according to claim 2 wherein the second plate assembly comprises a first flat wall with the respective inner and outer surface defining oppositely facing flat surfaces that are substantially parallel to each other and a first reference plane, the oppositely facing flat surfaces bound a first thickness, and a first tab that is transverse to the first reference plane and the first trip component is mounted to the first tab for guided pivoting movement between the normal and actuated positions.

15. The latch assembly combination according to claim 14 wherein the first flat wall and first tab are formed as one piece.

16. The latch assembly combination according to claim 14 wherein the first tab projects from the first wall at a first location, the third plate assembly comprises a second flat wall with a shape generally similar to the first flat wall including its respective inner and outer surfaces defining oppositely facing flat surfaces that are parallel to each other and a second reference plane, the third plate assembly comprising a second tab that is transverse to the second reference plane and is at a second location on the second flat wall that is different than a location on the second flat wall corresponding to the first location on the first wall.

17. The latch assembly combination according to claim 14 wherein the third plate assembly comprises a second flat wall with the respective inner and outer surfaces defining oppositely facing surfaces that are parallel to each other and a second reference plane and the third plate assembly comprises first and second tabs that are each transverse to the second reference plane and define a support for a second trip assembly, a second trip component is mounted to the third plate assembly for guided movement between: a) a normal position; and b) an actuated position, and with the third plate assembly operatively joined to the first plate assembly movement of the first trip component from the normal position into the actuated position causes the catch to be moved from the engaged position into the disengaged position.

18. The latch assembly combination according to claim 17 wherein the second trip component is mounted directly to each of the first and second tabs for guided movement between the normal and actuated positions.

19. The latch assembly combination according to claim 17 wherein the second trip component is mounted directly to the first tab for guided movement between its normal and actuated position.

20. The latch assembly combination according to claim 19 in combination with a third trip component that is mounted directly to the second tab for guided pivoting movement between: a) a normal position, and b) an actuated position, movement of the third trip component from its normal position into its actuated position causing the catch to be moved from the engaged position into the disengaged position.

21. The latch assembly combination according to claim 20 wherein the third trip component is not mounted directly to the first tab.

22. The latch assembly combination according to claim 17 wherein there are different numbers of tabs on the second and third plate assemblies that project transversely respectively with respect to the first and second reference planes.

23. The latch assembly combination according to claim 1 wherein at least one of the rotor and catch is made from first and second different materials.

24. The latch assembly combination according to claim 23 wherein the at least one of the rotor and catch has a bore to receive one of the axles which guides the at least one of the rotor and catch in pivoting movement around the axis of the one of the axles, the bore in the at least one of the rotor and catch is bounded by a surface defined at least in part by the first material, and the first material is of a nature that it causes the at least one of the rotor and catch and one axle to generate less noise by moving guidingly against each other than would the at least one of the rotor and catch if the at least part of the surface was defined by the second material.

25. The latch assembly combination according to claim 24 wherein the first material is at least one of: a) rubber; b) plastic; and c) a composite.

26. The latch assembly combination according to claim 23 wherein the at least one of the rotor and catch has an exposed surface defined by the second material and the first material covers only a part of the exposed surface.

27. The latch assembly combination according to claim 23 wherein the at least one of the rotor and catch has an exposed surface defined by the second material and the first material covers substantially the entirety of the exposed surface.

28. The latch assembly combination according to claim 25 wherein the second material comprises metal.

29. The latch assembly combination according to claim 1 wherein at least one of the rotor and catch has a bore bounded by a first surface that is guided against a second surface on one of the axles that extends into the bore and at least one of the first and second surfaces is defined by a first material that is applied over a second material and that has a tendency to prevent noise generation more effectively than would the first material as the first and second surfaces are moved guidingly against each other.

30. The latch assembly combination according to claim 1 wherein there are cooperating first and second surfaces respectively on the rotor and catch that interact to cause the catch in the engaged position to block the rotor in the latched position, and at least one of the first and second surfaces is defined by a first material that is applied over a second material.

31. The latch assembly combination according to claim 30 wherein the first material tends to avoid noise generation more effectively than would the second material as the first and second surfaces interact.

32. The latch assembly combination according to claim 2 further comprising a second trip assembly with a second trip component that is mounted to the second plate assembly for guided movement between: a) a normal position; and b) an actuated position, with the second plate assembly operatively joined to the first plate assembly selective movement of either of the first and second trip components from its normal position into its actuated position causes the catch to be moved from the engaged position into the disengaged position.

33. The latch assembly combination according to claim 32 wherein the catch has spaced first and second surfaces upon which the first and second trip components respectively act.

34. The latch assembly combination according to claim 2 wherein the actuating system comprises an actuator assembly.

35. The latch assembly combination according to claim 1 wherein the first trip component defines an actuating assembly on the actuating system that is directly engagable and repositionable by a user.

36. The latch assembly combination according to claim 34 wherein the actuator assembly comprises an actuator element that is operated remotely from the first trip component.

37. The latch assembly combination according to claim 34 further in combination with a closure element that is movable guidingly relative to a support between first and second positions and a strike assembly with a strike element, the latch assembly and strike assembly provided one each on the support and closure element and cooperating to releasably maintain the closure element in one of the first and second positions.

38. The latch assembly combination according to claim 37 wherein the rotor defines a receptacle for the strike element and the rotor and at least one of a) the first plate assembly; and b) one of the at least second and third plate assemblies that is operatively joined to the first plate assembly cooperate to maintain the strike element in the rotor receptacle with the rotor in the latched position and the closure element in the one of the first and second positions.

39. The latch assembly combination according to claim 38 wherein the rotor and the first plate assembly and the one of the at least second and third plate assemblies that is operatively joined to the first plate assembly cooperate to maintain the strike element in the rotor receptacle with the rotor in the latched position and the closure element in the one of the first and second positions.

40. The latch assembly combination according to claim 1 wherein with the second plate assembly operatively joined to the first plate assembly, the first plate assembly and second plate assembly define a housing with a generally rectangular shape with a perimeter edge consisting of spaced length edge portions, spaced width edge portions, and a chamber within which the rotor and catch reside, the spaced length and width edge portions each having perimeter dimensions with the majority of the perimeter dimension of at least one of the length and width edge portions open so that the chamber is exposed at the majority of the perimeter dimension of the at least one of the length and width edge portions.

41. The latch assembly combination according to claim 40 wherein the majority of the entire perimeter edge is open so that the chamber is exposed at the majority of the entire perimeter edge.

42. The latch assembly combination according to claim 37 wherein the strike element comprises a closed hoop.

43. The latch assembly combination according to claim 9 wherein the rotor is substantially the same with each of the at least second and third plate assemblies operatively joined to the first plate assembly.

44. The latch assembly combination according to claim 43 wherein the catch is substantially the same with each of the at least second and third plate assemblies operatively joined to the first plate assembly.

45. The latch assembly combination according to claim 11 wherein the flat wall has an exposed perimeter edge with a perimeter length and a majority of the perimeter length resides between spaced planes within which the oppositely facing flat surfaces reside and has the first thickness.

46. The latch assembly combination according to claim 14 wherein the first flat wall has an exposed perimeter edge with a perimeter length and a majority of the perimeter length resides between spaced planes within which the oppositely facing flat surfaces reside and has the first thickness.

47. The latch assembly combination according to claim 1 wherein the different latch configurations are for opposite-handed operation and the opposite-handed operation is left- and right-handed operation and the catch and rotor are the same with the latch assembly configured for both left- and right-handed operation.

48. The latch assembly combination according to claim 47 wherein the biasing assembly is the same with the latch assembly configured for both left- and right-handed operation.

49. The latch assembly combination according to claim 1 wherein the first plate assembly has spaced sides and the first and second sides are mirror images of each other relative to a line that bisects the first plate assembly between the spaced sides of the first plate assembly.

50. The latch assembly combination according to claim 1 wherein with the first plate assembly operatively joined to any of the at least first and second plate assemblies, the first plate assembly and joined plate assembly define a housing with spaced sides, between which the axles reside, that are open.

51. The latch assembly combination according to claim 2 wherein the second plate assembly has first and second spaced end portions joined by a connecting portion.

52. The latch assembly combination according to claim 51 wherein one of the spaced end portions on the second plate assembly is configured to mount the trip component in first and second different locations on the one spaced end portion for guided movement to cause the catch to be moved with the second plate assembly in two different operative relationships with the first plate assembly.

53. The latch assembly combination according to claim 52 wherein the connecting portion has a locally reduced area as viewed along the first and second axes.

* * * * *